US010948166B2

(12) United States Patent
Ohara et al.

(10) Patent No.: US 10,948,166 B2
(45) Date of Patent: Mar. 16, 2021

(54) LIGHTING APPARATUS

(71) Applicant: PANASONIC INTELLECTUAL PROPERTY MANAGEMENT CO., LTD., Osaka (JP)

(72) Inventors: Kazuaki Ohara, Osaka (JP); Kazuma Uematsu, Kyoto (JP); Hidekazu Yuasa, Shiga (JP); Kazuto Toyama, Mie (JP); Toshio Kudo, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/318,911

(22) PCT Filed: Aug. 29, 2017

(86) PCT No.: PCT/JP2017/030823
§ 371 (c)(1),
(2) Date: Jan. 18, 2019

(87) PCT Pub. No.: WO2018/043441
PCT Pub. Date: Mar. 8, 2018

(65) Prior Publication Data

US 2019/0234587 A1 Aug. 1, 2019

(30) Foreign Application Priority Data

Aug. 30, 2016 (JP) ..... JP2016-168431

(51) Int. Cl.
*F21V 14/02* (2006.01)
*F21L 4/04* (2006.01)
(Continued)

(52) U.S. Cl.
CPC ..... *F21V 14/025* (2013.01); *F21L 4/02* (2013.01); *F21L 4/04* (2013.01); *F21V 21/096* (2013.01);
(Continued)

(58) Field of Classification Search
CPC ..... F21L 15/00–14; F21L 2001/00; F21L 2003/00; F21L 2005/00; F21L 4/04;
(Continued)

(56) References Cited

U.S. PATENT DOCUMENTS 5,871,274 A 2/1999 Lee et al.
5,971,562 A * 10/1999 Yang ..... F21L 4/045 362/184
(Continued)

FOREIGN PATENT DOCUMENTS

CN 201155699 Y 11/2008
DE 29504976 U1 * 5/1995 ..... F21L 4/022
(Continued)

OTHER PUBLICATIONS

Machine translation of EP 2840297 A1 retrieved from Espacenet. (Year: 2020).*
(Continued)

*Primary Examiner* — Alexander K Garlen
*Assistant Examiner* — Colin J Cattanach
(74) *Attorney, Agent, or Firm* — McDermott Will and Emery LLP

(57) ABSTRACT

Hinge devices couple light source units to a base such that the light source units are rotatable around first axes. Each light source unit is rotatable between a first position and a second position around a corresponding first axis of the first axes. Rotation mechanisms couple the light source units to the hinge devices such that the light source units are rotatable around second axes transverse to the first axes. The
(Continued)

hinge devices are configured such that when each light source unit rotates from the first position to the second position, rotation directions of the light source units are different. The rotation mechanisms define rotation ranges of the light source units around the second axes to achieve a reference state where the light source units are collected together and light-outgoing surfaces of the light source units face outward when each light source unit is in the first position.

14 Claims, 23 Drawing Sheets

(51) Int. Cl.

| | |
|---|---|
| ***F21V 21/30*** | (2006.01) |
| ***F21L 4/02*** | (2006.01) |
| ***F21V 21/40*** | (2006.01) |
| ***F21V 21/096*** | (2006.01) |
| ***F21V 21/26*** | (2006.01) |
| ***F21V 21/14*** | (2006.01) |
| ***F21V 23/02*** | (2006.01) |
| ***F21V 23/04*** | (2006.01) |
| ***F21Y 115/10*** | (2016.01) |
| ***F21Y 103/10*** | (2016.01) |

(52) U.S. Cl.
CPC ..... *F21V 21/0965* (2013.01); *F21V 21/145* (2013.01); *F21V 21/26* (2013.01); *F21V 21/30* (2013.01); *F21V 21/406* (2013.01); *F21V 23/02* (2013.01); *F21V 23/0414* (2013.01); *F21Y 2103/10* (2016.08); *F21Y 2115/10* (2016.08)

(58) Field of Classification Search
CPC ..... F21L 4/045; F21L 4/027; F21V 21/26; F21V 21/30; F21V 21/145; F21V 21/40; F21V 21/406; F21V 23/002; F21V 5/006; F21V 7/0075; F21V 13/045; F21V 14/085; F21V 14/025; F21V 14/045; F21V 14/065; F21V 21/09; F21V 21/65; F21V 23/0414; F21V 23/0421; F21V 23/0428; B60Q 3/35; B60Q 3/59; B60Q 7/02; B60Q 7/00
See application file for complete search history.

(56) References Cited

U.S. PATENT DOCUMENTS

| | | | | |
|---|---|---|---|---|
| D445,932 | S * | 7/2001 | Ceder | D26/42 |
| 7,347,582 | B1 * | 3/2008 | Kung | F21L 4/00 362/177 |
| 7,591,572 | B1 * | 9/2009 | Levine | A47F 11/10 362/191 |
| D695,434 | S * | 12/2013 | Shen | D26/41 |
| 2007/0097689 | A1 * | 5/2007 | Barausky | F21S 6/003 362/287 |
| 2008/0013305 | A1 | 1/2008 | Kang et al. | |
| 2008/0013307 | A1 | 1/2008 | Kang et al. | |
| 2009/0284963 | A1 * | 11/2009 | Intravatola | F16M 11/28 362/190 |
| 2009/0296412 | A1 | 12/2009 | Ogawa et al. | |
| 2012/0140467 | A1 * | 6/2012 | Chang | F21L 2/00 362/235 |
| 2012/0188756 | A1 | 7/2012 | Kokoski et al. | |
| 2013/0100653 | A1 * | 4/2013 | Renk, Jr. | F21L 4/022 362/184 |
| 2013/0128565 | A1 * | 5/2013 | Cugini | F21V 21/145 362/184 |
| 2013/0335996 | A1 | 12/2013 | Yao et al. | |
| 2014/0301066 | A1 * | 10/2014 | Inskeep | F21S 9/02 362/183 |
| 2014/0376218 | A1 * | 12/2014 | Ni | F21V 29/89 362/217.14 |
| 2015/0062902 | A1 * | 3/2015 | Velazquez | F21V 21/14 362/249.07 |
| 2015/0330558 | A1 * | 11/2015 | Intravatola | F16M 11/24 362/184 |
| 2015/0354794 | A1 * | 12/2015 | Guercio | F21V 21/30 362/235 |
| 2016/0265754 | A1 * | 9/2016 | Sun | F21L 4/04 |
| 2016/0312967 | A1 * | 10/2016 | Harvey | F21V 17/007 |
| 2016/0360585 | A1 * | 12/2016 | Urry | H05B 33/0845 |
| 2018/0058673 | A1 * | 3/2018 | Fang | F21V 27/02 |
| 2018/0163957 | A1 * | 6/2018 | Zhou | F21V 21/06 |
| 2018/0340661 | A1 * | 11/2018 | Inskeep | F21V 23/0414 |

FOREIGN PATENT DOCUMENTS

| | | | |
|---|---|---|---|
| DE | 296 08 888 | U1 | 8/1996 |
| EP | 2 056 652 | A1 | 5/2009 |
| EP | 2 840 297 | A1 | 2/2015 |
| JP | H03-022301 | A | 1/1991 |
| JP | 2006-190661 | A | 7/2006 |
| JP | 2006-210042 | A | 8/2006 |
| JP | 2007-311055 | A | 11/2007 |
| JP | 2009-503805 | A | 1/2009 |
| JP | 2010-010124 | A | 1/2010 |
| JP | 2010-192445 | A | 9/2010 |
| JP | 2011-186322 | A | 9/2011 |
| JP | 2013-065411 | A | 4/2013 |
| JP | 2015-099738 | A | 5/2015 |
| JP | 2016-051598 | A | 4/2016 |
| KR | 101266419 | B1 | 5/2013 |
| WO | 01/01039 | A1 | 1/2001 |

OTHER PUBLICATIONS

Machine translation of JP H0322301 A retrieved from Espacenet. (Year: 2020).*
International Search Report and Written Opinion issued in International Application No. PCT/JP2017/030823 dated Nov. 14, 2017; with partial English translation.
Extended European Search Report issued in European Patent Application No. 17846446.7, dated Jun. 25, 2019.
European Office action dated Apr. 17, 2020 issued in corresponding European Patent Application No. 17846446. 7.
Japanese Office Action dated Oct. 13, 2020, issued in the corresponding Japanese Patent Application No. 2016-168431; with English translation.
European Ooffice Action dated Nov. 17, 2020 issued in corresponding European Patent Application No. 17846446.7.

* cited by examiner 1a
15
18
151
155
3
14
5
52
54
20
2
10
9
4
3 (3A)
3 (3B)
3222
X1
X2
31
311
97

LIGHTING APPARATUS

CROSS-REFERENCE OF RELATED APPLICATIONS

This application is the U.S. National Phase under 35 U.S.C. § 371 of International Patent Application No. PCT/JP2017/030823, filed on Aug. 29, 2017, which in turn claims the benefit of Japanese Application No. 2016-168431, filed on Aug. 30, 2016, the entire disclosures of which Applications are incorporated by reference herein.

TECHNICAL FIELD

The present invention generally relates to lighting apparatuses and specifically, to a lighting apparatus configured to change light distribution.

BACKGROUND ART

As a lighting apparatus, a lighting device including a body, an illumination section, and a battery pack has been proposed (Patent Literature 1). The body has a bar shape so as to be grippable by a user. The illumination section is provided to one end in a longitudinal direction of the body. The battery pack is attachably/detachably attached to the other end in the longitudinal direction of the body.

The illumination section is swingable to the body and foldable to the body via a coupler formed at the one end in the longitudinal direction of the body.

In the field of the lighting apparatus, it may be desirable to realize various light distributions.

CITATION LIST

Patent Literature

Patent Literature 1: JP 2016-51598 A

SUMMARY OF INVENTION

It is an object of the present embodiment to provide a lighting apparatus configured to realize various light distributions.

A lighting apparatus of one aspect according to the present invention includes a base, a plurality of light source units, and a coupling device. The coupling device couples the plurality of light source units to the base. The coupling device includes a plurality of hinge devices and a plurality of rotation mechanisms. The plurality of hinge devices couple the plurality of light source units to the base such that the plurality of light source units are rotatable around first axes. Each of the plurality of light source units is rotatable between a first position and a second position around a corresponding first axis of the first axes. The plurality of rotation mechanisms couple the plurality of light source units to the plurality of hinge devices such that the plurality of light source units are rotatable around second axes transverse to the first axes. The plurality of hinge devices are configured such that when each of the plurality of light source units rotates from the first position to the second position, rotation directions of the plurality of light source units are different. The plurality of rotation mechanisms define rotation ranges of the plurality of light source units around the second axes to achieve a reference state where the plurality of light source units are collected together and light-outgoing surfaces of the plurality of light source units face outward when each of the plurality of light source units is in the first position.

DESCRIPTION OF EMBODIMENTS

First Embodiment

Figure 1:
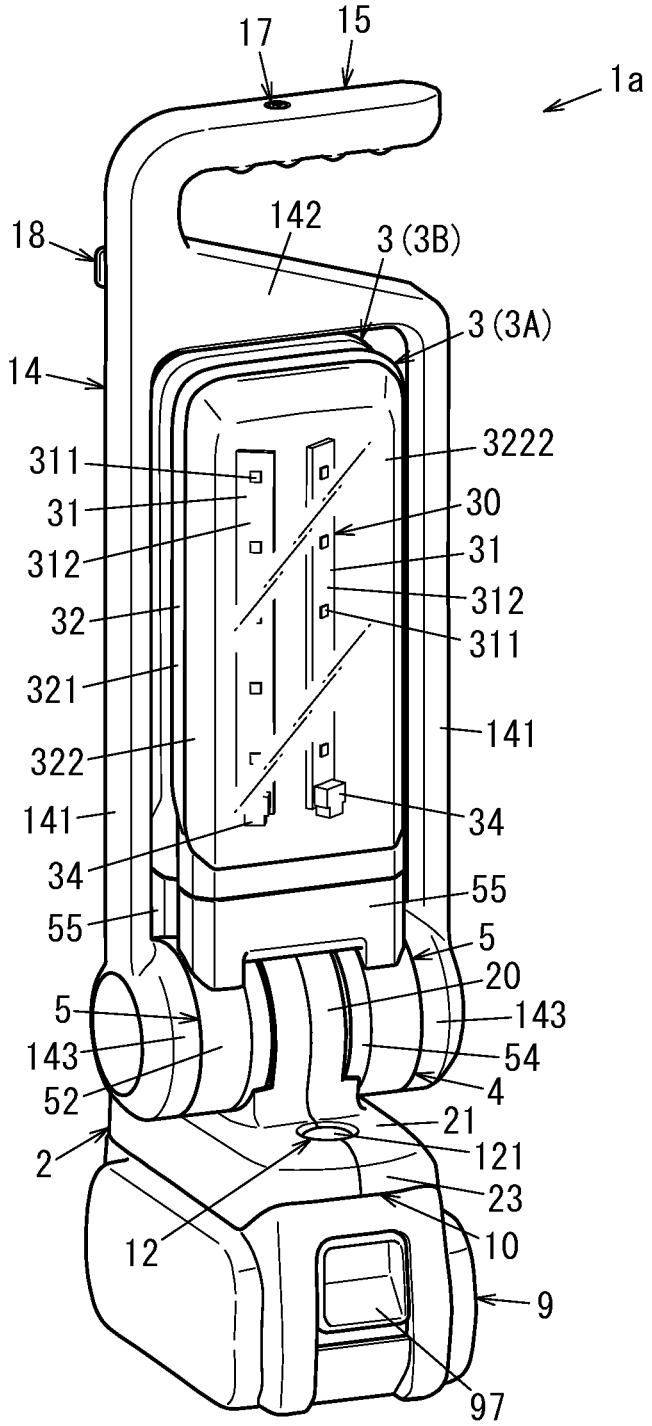
FIG. 1 is a perspective view illustrating a lighting apparatus according to a first embodiment of the present invention.

With reference to FIGS. 1 to 13, a lighting apparatus 1*a* of the present embodiment will be described below.

The lighting apparatus 1*a* is a portable lighting apparatus and specifically, a lantern. The lighting apparatus 1*a* is also usable as a floodlight or the like.

The lighting apparatus 1*a* includes a base 2, a plurality of (in this embodiment, two) light source units 3, and a coupling device 4. The coupling device 4 couples the plurality of light source units 3 to the base 2. The lighting apparatus 1*a* further includes a power supply unit 8 (see FIG. 4) which lights the plurality of light source units 3. In this embodiment, the lighting apparatus 1*a* further includes a battery pack 9 which supplies power to the power supply unit 8. The battery pack 9 is attached to an attachment part 10 provided to the base 2 so as to be electrically connected to the power supply unit 8. The lighting apparatus 1*a* further includes a handle 14. The lighting apparatus 1*a* further includes a grip 15. Thus, a person may hold the grip 15, for example, when transporting the lighting apparatus 1*a*.

The battery pack 9 (see FIG. 6) includes a plurality of (e.g., five) secondary batteries (e.g., lithium ion batteries), a housing body 91 shaped like a rectangular parallelepiped, and a projection base section 92 shaped like a flat rectangular parallelepiped. The housing body 91 accommodates the plurality of secondary batteries. The projection base section 92 is a part protruding from one surface 911 of the housing body 91. The housing body 91 and the projection base section 92 are electrically insulative. In the battery pack 9, the five lithium ion batteries are connected to each other in series in the housing body 91. The rated voltage of the battery pack 9 is 18 V. The battery pack 9 includes a communication connector 99. The communication connector 99 is a connector for communication of battery information denoting information on the battery pack 9. The battery information includes temperature information, residual capacity information, rated voltage information, rated capacity information, count information, and the like. As the battery pack 9, for example, a lithium ion battery pack EZ9L54 (item number) which is manufactured by Panasonic Corporation may be adopted.

The projection base section 92 includes a first end 921 and a second end 922 in a longitudinal direction of the projection base section. The battery pack 9 has three insertion grooves 931, 932, and 933 in the first end 921 of the projection base section 92. The three insertion grooves 931, 932, and 933 respectively accommodate female connection terminals 961, 962, and 963. Moreover, the battery pack 9 includes three hooks 941, 942, and 943 which are L-shaped and which are provided to each of the pair of side surfaces 923 in a short direction of the projection base section 92. The battery pack 9 further includes a lock section 95 exposed on the one surface 911 of the housing body 91 and disposed between the hook 942 and the hook 943. The lock section 95 is inserted through a hole 915 in a wall including the one surface 911 of the housing body 91. The lock section 95 receives, from a return spring accommodated in the housing body 91, force in a direction in which the lock section 95 protrudes from the one surface 911 of the housing body 91. In this embodiment, the return spring is a compression coil spring. The battery pack 9 further includes an unlock manipulation section 97 (see FIGS. 1 and 4) configured to release a locked state by the lock section 95.

The battery pack 9 is detachably attached to the attachment part 10 (see FIGS. 1 and 5) provided to the base 2.

The base 2 is shaped like a flat rectangular parallelepiped and has a first surface 21 and a second surface 22 (see FIG. 5) in a thickness direction thereof. The base 2 is electrically insulative. The base 2 is hollow and is configured to accommodate the power supply unit 8.

Figure 5:
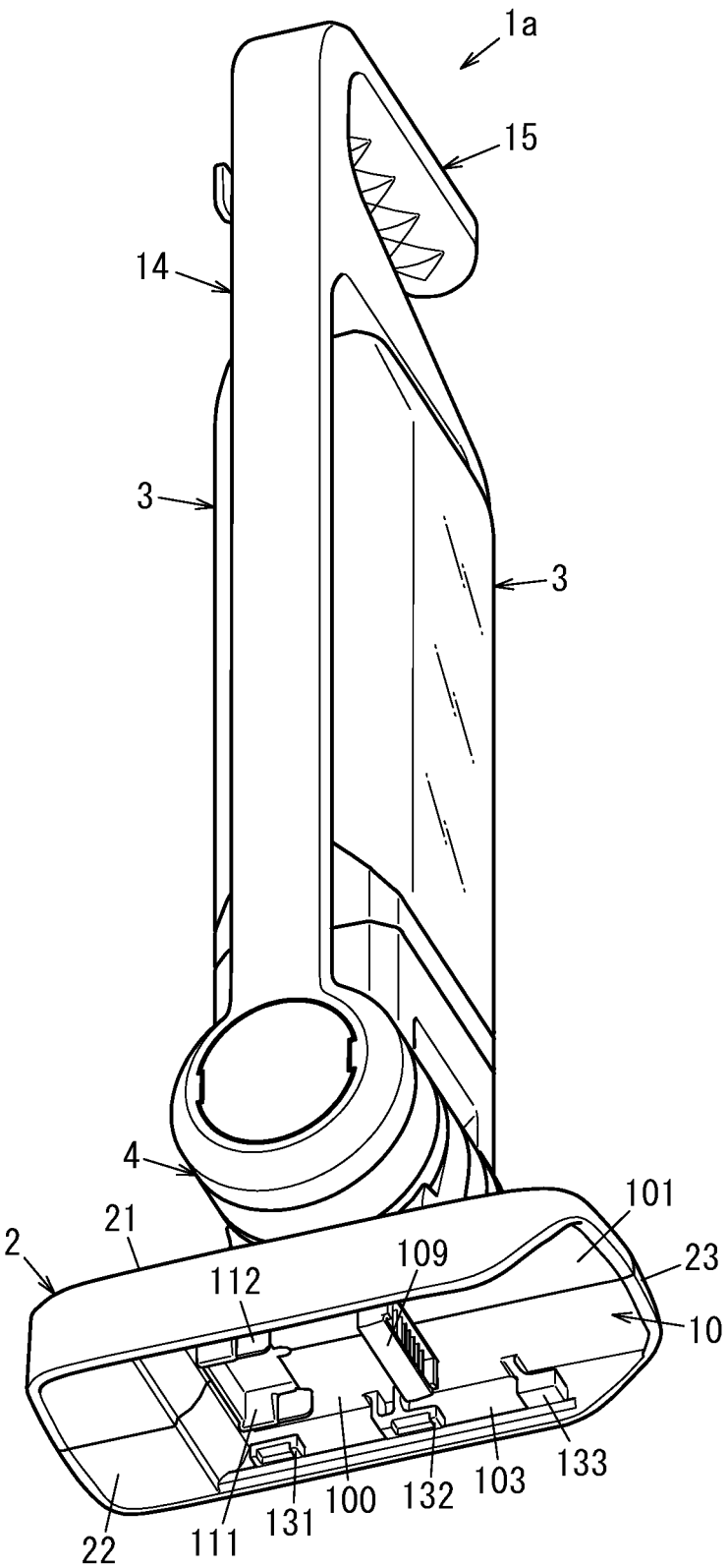
FIG. 5 is a perspective view illustrating the lighting apparatus with a battery pack being detached.
Figure 6:
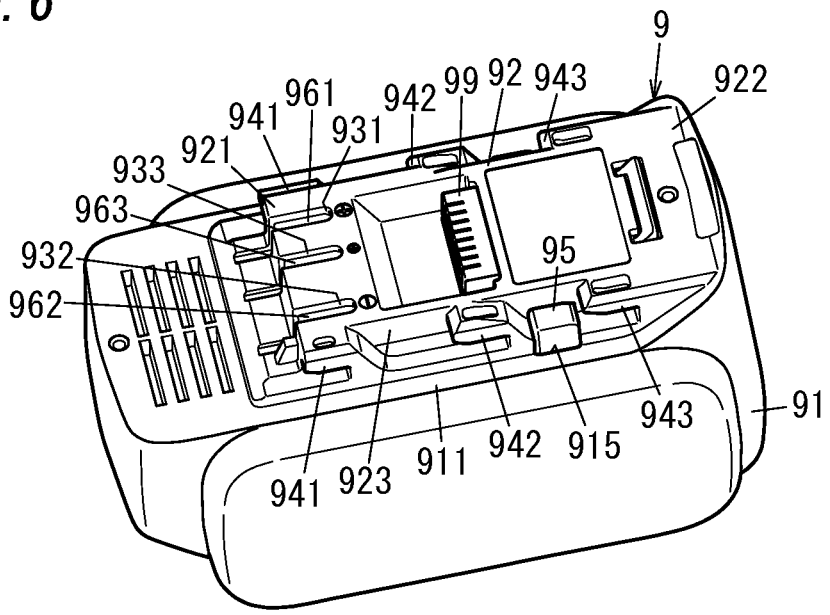
FIG. 6 is a perspective view illustrating the battery pack of the lighting apparatus.
Figure 7:
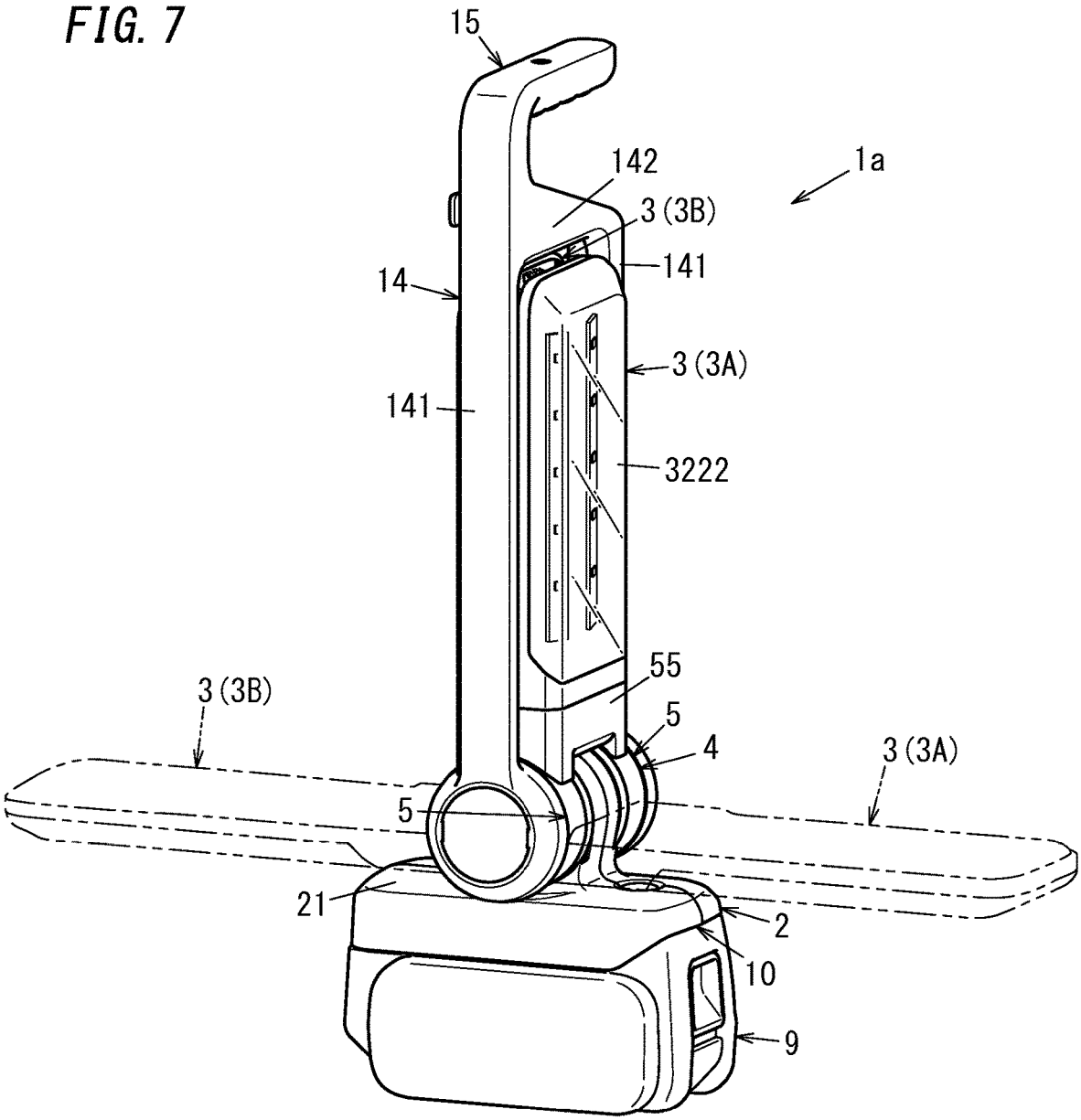
FIG. 7 is a view illustrating a first position and a second position of each of a plurality of light source units of the lighting apparatus.
Figure 8:
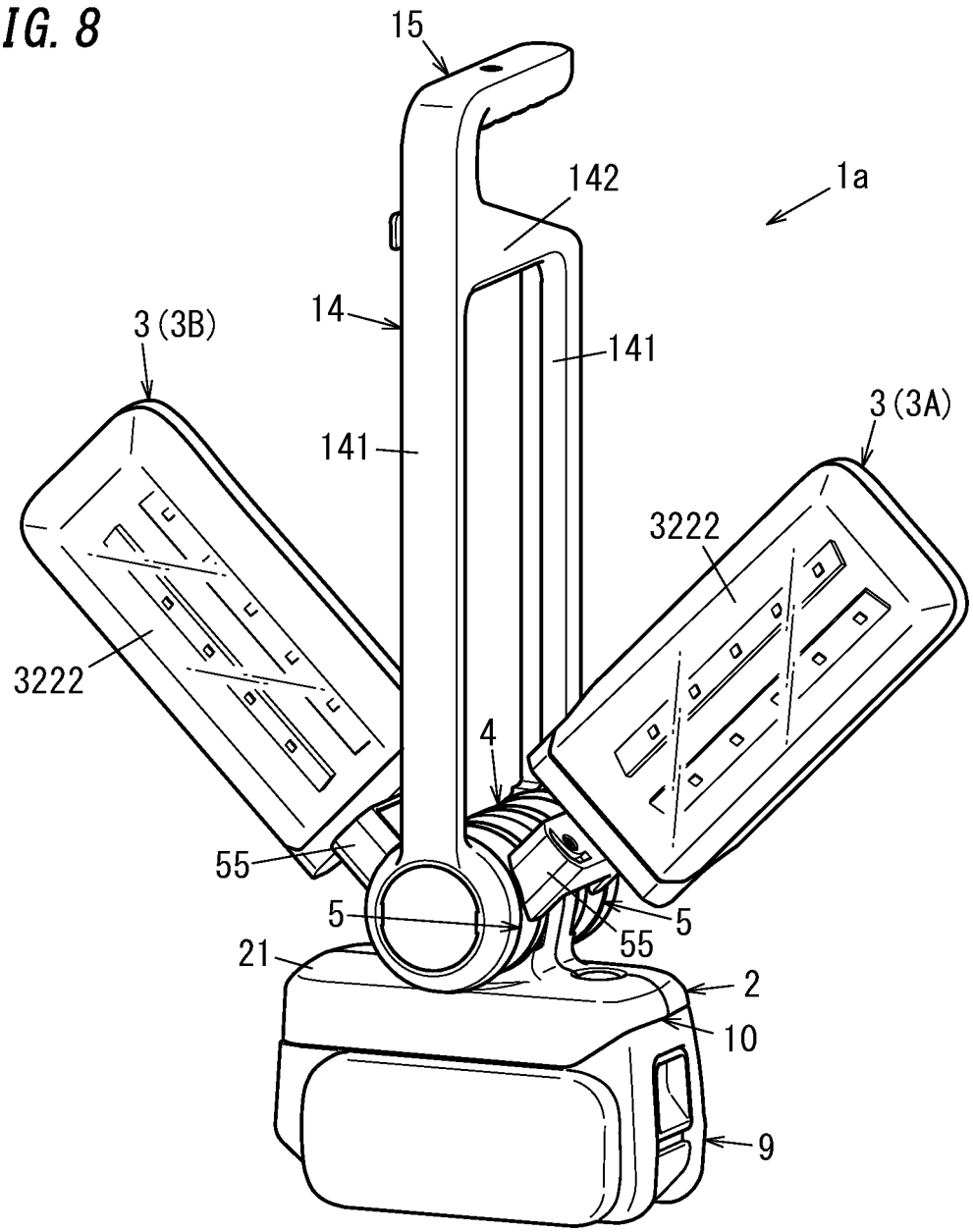
FIG. 8 is a perspective view illustrating an exemplary use of the lighting apparatus.

As illustrated in FIG. 5, the attachment part 10 has a recess 100 formed in the second surface 22 of the base 2 and accommodating the projection base section 92 of the battery pack 9 (see FIG. 6). The recess 100 is open at the second surface 22 of the base 2 and at one side surface 23 in a longitudinal direction of the base 2. The attachment part 10 has three hooks 131, 132, and 133 which are L-shaped, which are provided to each of a pair of inner side surfaces 103 in a short direction of the recess 100, and which are respectively engaged with the hooks 941, 942, and 943 of the battery pack 9. The attachment part 10 further includes a communication connector 109 and two power supply terminals 111 and 112. The communication connector 109 is connectable to the communication connector 99 of the battery pack 9. The two power supply terminals 111 and 112 respectively inserted and connected to the two connection terminals 961 and 962 of the three connection terminals 961, 962, and 963 of the battery pack 9. In this embodiment, the connection terminal 961 is a power supply terminal of a positive electrode of the battery pack 9. The connection terminal 962 is a power supply terminal of a negative electrode of the battery pack 9.

To attach the battery pack 9 to the attachment part 10, for example, the projection base section 92 of the battery pack 9 is inserted into the recess 100 in the attachment part 10 from the second surface 22 of the base 2 so that the hooks 941, 942, and 943 of the battery pack 9 do not interfere with the hooks 131, 132, and 133 of the attachment part 10. Then, the battery pack 9 is shifted toward the first end 921 of the projection base section 92, thereby allowing the battery pack 9 to be attached to the attachment part 10. When the battery pack 9 is attached to the attachment part 10, the hooks 941, 942, and 943 of the battery pack 9 are respectively engaged with the hooks 131, 132, and 133 of the attachment part 10. Moreover, a locked state where the lock section 95 of the battery pack 9 locks the hook 133 of the attachment part 10 is achieved, wherein the hook 133 is engaged with the hook 943 of the battery pack 9.

To detach the battery pack 9 from the attachment part 10, for example, the unlock manipulation section 97 provided to the battery pack 9 is manipulated to move the lock section 95 disposed between the hook 942 and the hook 943 against the spring force of the return spring and to shift the battery pack 9 in a direction of the second end 922 of the projection base section 92, and then, the battery pack 9 is moved in a direction to be away from an inner bottom surface 101 of the recess 100 in the attachment part 10.

In the lighting apparatus 1*a*, the power supply unit 8 (see FIG. 4) is accommodated in the base 2. The power supply unit 8 is configured to be supplied with power from the battery pack 9 attached to the attachment part 10 so as to light the light sources 30 of the plurality of light source units 3. The power supply unit 8 generates, from direct-current power supplied from the battery pack 9, direct-current power for lighting the light sources 30 of the plurality of light source units 3. More specifically, the power supply unit 8 includes a step-up circuit configured to step up a direct-current voltage supplied from the battery pack 9. The step-up circuit includes a control circuit. The control circuit includes a microcontroller. The microcontroller is configured as a 1-chip device including a processor configured to operate in accordance with a program, memory for storing the program for operating the processor, and work memory. The control circuit is realizable by causing the microcontroller to execute the program. The power supply unit 8 includes a plurality of circuit elements 81 (an inductor, a switching element, a diode, a capacitor, a microcontroller, and the like) of the step-up circuit and a circuit board 82 on which the plurality of circuit elements 81 are mounted. The control circuit performs ON/OFF control of the switching element. On the circuit board 82 of the power supply unit 8, the pair of power supply terminals 111 and 112 and the communication connector 109 of the attachment part 10 are also mounted.

The lighting apparatus 1*a* includes a manipulation switch 12 (see FIGS. 1 and 4) for an instruction of full lighting (rated lighting), dimming lighting, and non-lighting of the light source unit 3. In the lighting apparatus 1*a*, the control circuit of the power supply unit 8 acquires a manipulation signal when the manipulation switch 12 is manipulated. As used herein, "the control circuit acquires a manipulation signal" may mean that the control circuit detects that the manipulation switch 12 is manipulated. The power supply unit 8 may be configured to switch the plurality of light source units 3 to a full lighting state, a dimming lighting state, and a non-lighting state sequentially each time the manipulation switch 12 is manipulated. The manipulation switch 12 is a push button switch. The manipulation switch 12 is mounted on the circuit board 82 of the power supply unit 8 and is connected to the control circuit of the power supply unit 8. The base 2 has a hole 211 (see FIG. 4) through which a push button 121 of the manipulation switch 12 is exposed on the first surface 21 of the base 2.

The power supply unit 8 includes a connector 84 to which a lead wire 39 (see FIGS. 4 and 12) for connecting the power supply unit 8 to the light source unit 3 is connected. The connector 84 is mounted on the circuit board 82.

Each light source unit 3 includes a light source 30 and a case 32. The light source 30 is accommodated in the case 32. The light source 30 includes two light emitting diode (LED) modules 31. Each of the two LED modules 31 includes an LED 311 and a circuit board 312 on which the LED 311 is mounted. Moreover, each of the two LED modules 31 further includes a connector 34 (see FIG. 1) to which the lead wire 39 for connecting the light source unit 3 to the power supply unit 8 is connected.

Each LED 311 is, for example, a surface-mounted LED. The light source color of each LED 311 is preferably set based on a correlated color temperature of a light source color of an LED defined in accordance with, for example, JIS Z9112:2012. The light source color of the LED 311 is neutral white but is not limited to this example and may be, for example, an incandescent color.

Each circuit board 312 is, for example, a printed wiring board. Preferably, the printed wiring board is highly thermally conductive. The printed wiring board is formed of, for example, a woven/non-woven glass cloth composite base material epoxy resin copper clad laminated board satisfying the specification of the composite epoxy materials-3 (CEM-3).

Each LED module 31 preferably includes a plurality of (e.g., five) LEDs 311. In the LED module 31, the circuit board 312 has an elongated flat plate shape. In the LED module 31, the five LEDs 311 are arranged on the circuit board 312 to be aligned in a low along a longitudinal direction of the circuit board 312, and the five LEDs 311 are connected to each other in series. In the LED module 31, the five LEDs 311 are arranged at substantially the same intervals. The expression "substantially the same intervals" mentioned herein does not mean the same intervals in a strict sense, but intervals within a prescribed range are allowable.

In each of the plurality of light source units 3, the two circuit boards 312 are tilted in different directions to a flat surface orthogonal to a thickness direction of the light source unit 3 so as to increase the angle of light distribution as compared to a case where the two circuit boards 312 are arranged parallel to each other on one flat surface. Thus, each of the plurality of light source units 3 is disposed in the case 32 such that optical axes of the LEDs 311 of the two LED modules 31 are oriented in different directions.

Each LED module 31 may include, in the case 32, a reflector which reflects light from the light source 30 to a light-outgoing surface 3222.

The case 32 has a panel shape. The outer peripheral shape of the case 32 seen in a thickness direction of the case 32 is rectangular. The case 32 includes a body 321 holding the light source 30 and a cover 322. The body 321 holds the light source 30. The cover 322 is coupled to the body 321 to cover the light source 30 and has a surface at least part of which is included in the light-outgoing surface 3222. The body 321 is made of an ABS resin. The cover 322 is made of polycarbonate. In the case of the light source unit 3, light radiated from the light source 30 is emitted from the light-outgoing surface 3222.

The light source unit 3 further includes a projection 33 (see FIG. 4) protruding from a rear surface 3212 (see FIG. 4) on an opposite side of the case 32 from the light-outgoing surface 3222. This enables the lighting apparatus 1*a* to increase a heat dissipation area as compared to a case where the projection 33 is not provided on the rear surface 3212 and to improve heat dissipation characteristics. The light source unit 3 preferably includes a plurality of projections 33. This enables the lighting apparatus 1*a* to further improve the heat dissipation characteristics. According to the light source unit 3, the plurality of projections 33 are provided along a longitudinal direction of the case 32.

The lighting apparatus 1*a* includes a coupling device 4 coupling the plurality of (two) light source units 3 to the base 2. The coupling device 4 is configured to enable each of the plurality of light source units 3 to rotate around a corresponding one of first axes 50 (see FIG. 4) and around a corresponding one of second axes 60 (see FIG. 4) transverse to the first axes 50. The coupling device 4 includes a shaft body 7 (see FIGS. 3, 4, 9, and 10), a holder 20, a plurality of (two) hinge devices 5, and a plurality of (two) rotation mechanisms 6 (see FIGS. 4 and 11).

Figure 4:
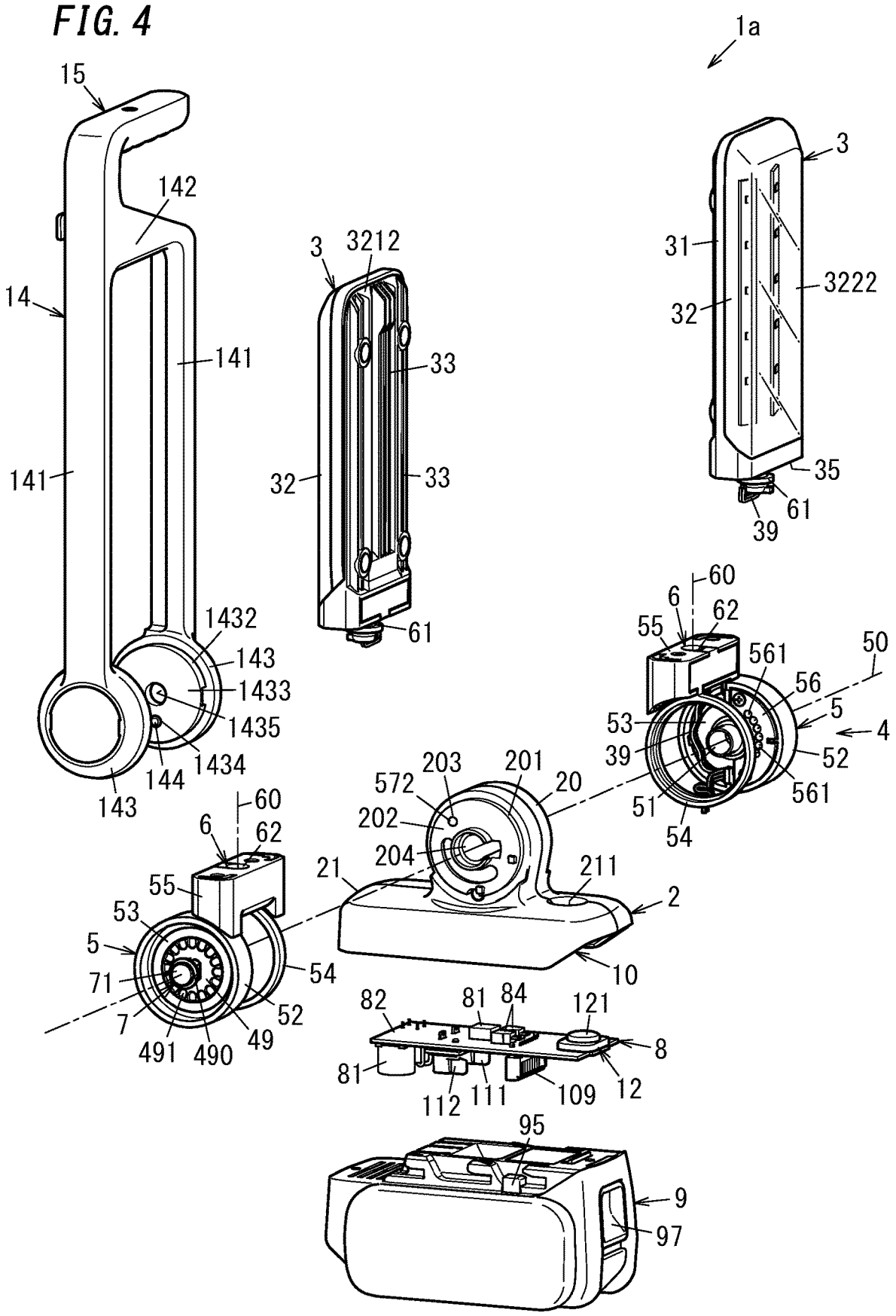
FIG. 4 is an exploded perspective view illustrating the lighting apparatus.
Figure 9:
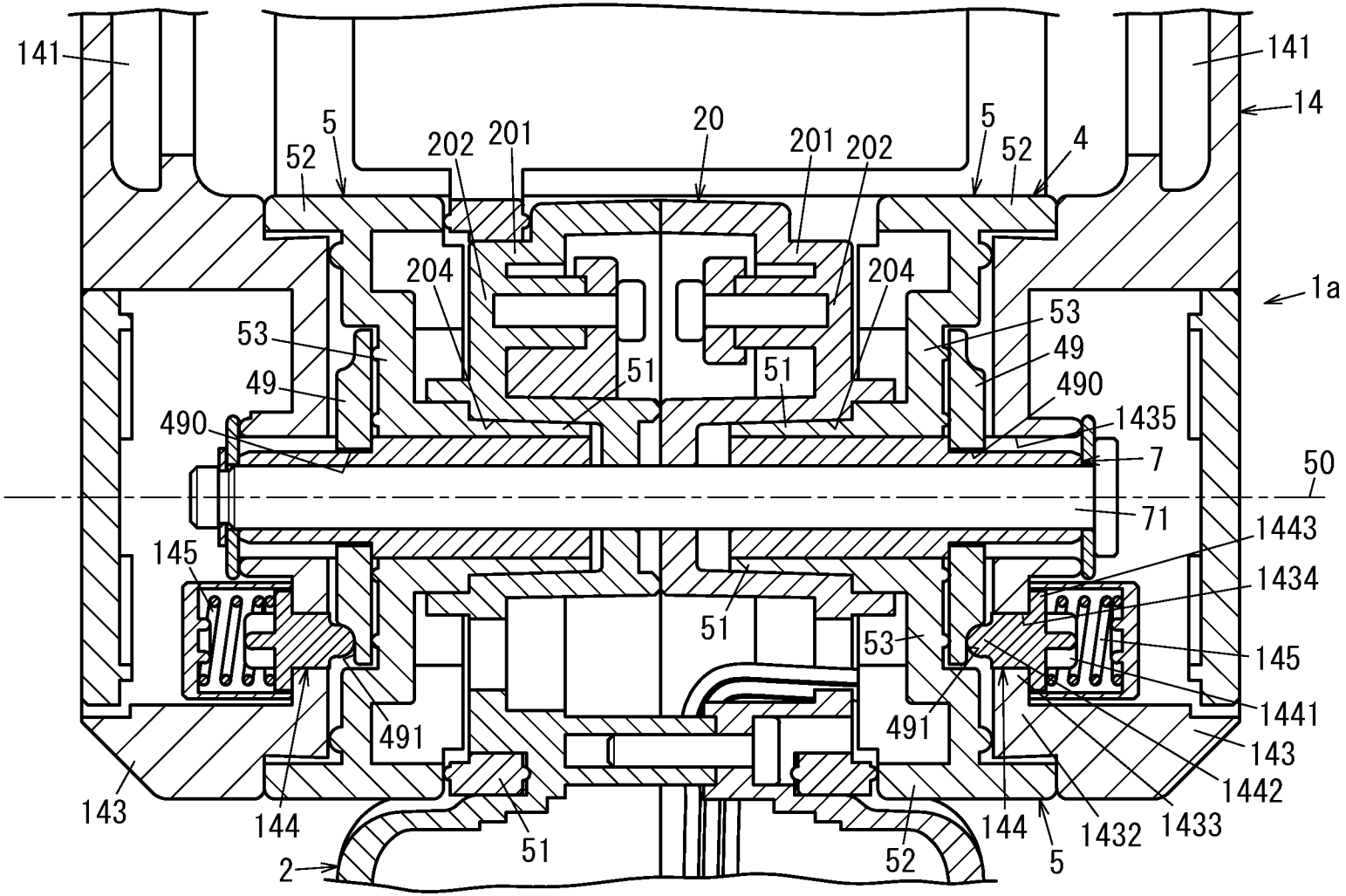
FIG. 9 is a sectional view illustrating the lighting apparatus taken along line X1-X1 of FIG. 2A.

As illustrated in FIGS. 4 and 9, in the lighting apparatus 1*a*, the shaft body 7 defines the first axes 50. In other words, in the lighting apparatus 1*a*, the axis line of the shaft body 7 forms the first axes 50. The shaft body 7 includes a shaft 71. The shaft body 7 is held by the holder 20. The holder 20 has a hollow columnar shape. The holder 20 protrudes from the first surface 21 of the base 2. In this embodiment, the holder 20 is formed integrally with the base 2. The holder 20 is disposed such that the axial direction thereof is a direction along a short direction of the base 2. The holder 20 includes a shaft section 201 (see FIGS. 4 and 9) provided at each of both ends in the axial direction of the holder and having a smaller outer diameter than a part between the both ends of the holder 20. The shaft body 7 is inserted through a hole 204 in each of the pair of shaft sections 201 of the holder 20 (see FIGS. 4 and 9).

Each hinge device 5 couples the light source unit 3 to the base 2 such that the light source unit 3 is rotatable between a first position (hereinafter also referred to as a "reference position") and a second position (hereinafter also referred to as a "spread position") around the first axis 50. The reference position is a position at which a tip of each one of the plurality of light source units 3 is located closest to a tip of the other light source unit 3. The spread position is a position at which each of the plurality of light source units 3 arrives after the largest angle of rotation from the reference position.

Each hinge device 5 includes a bearing 51, a ring section 52, a coupler 53, a hinge section 54, and an arm 55.

The bearing 51 has a cylindrical shape. The bearing 51 is rotatably supported by the shaft body 7.

The ring section 52 surrounds the bearing 51 and is concentric with the bearing 51. The inner diameter of the ring section 52 is larger than the outer diameter of the bearing 51. The ring section 52 is away from the bearing 51 in the radial direction of the ring section 52.

The coupler 53 is disposed between the bearing 51 and the ring section 52 and couples the bearing 51 to the ring section 52.

The hinge section 54 is rotatably held by one shaft section 201 of the two shaft sections 201 of the holder 20 which is located away from the bearing 51. The shaft section 201 is concentric with the ring section 52.

The arm 55 couples the ring section 52 to the hinge section 54. The arm 55 protrudes radially outward from each of the ring section 52 and the hinge section 54. The arm 55 rotates together with the ring section 52 and the hinge section 54. In the lighting apparatus 1*a*, the light source unit 3 is coupled to the arm 55.

Figure 10:
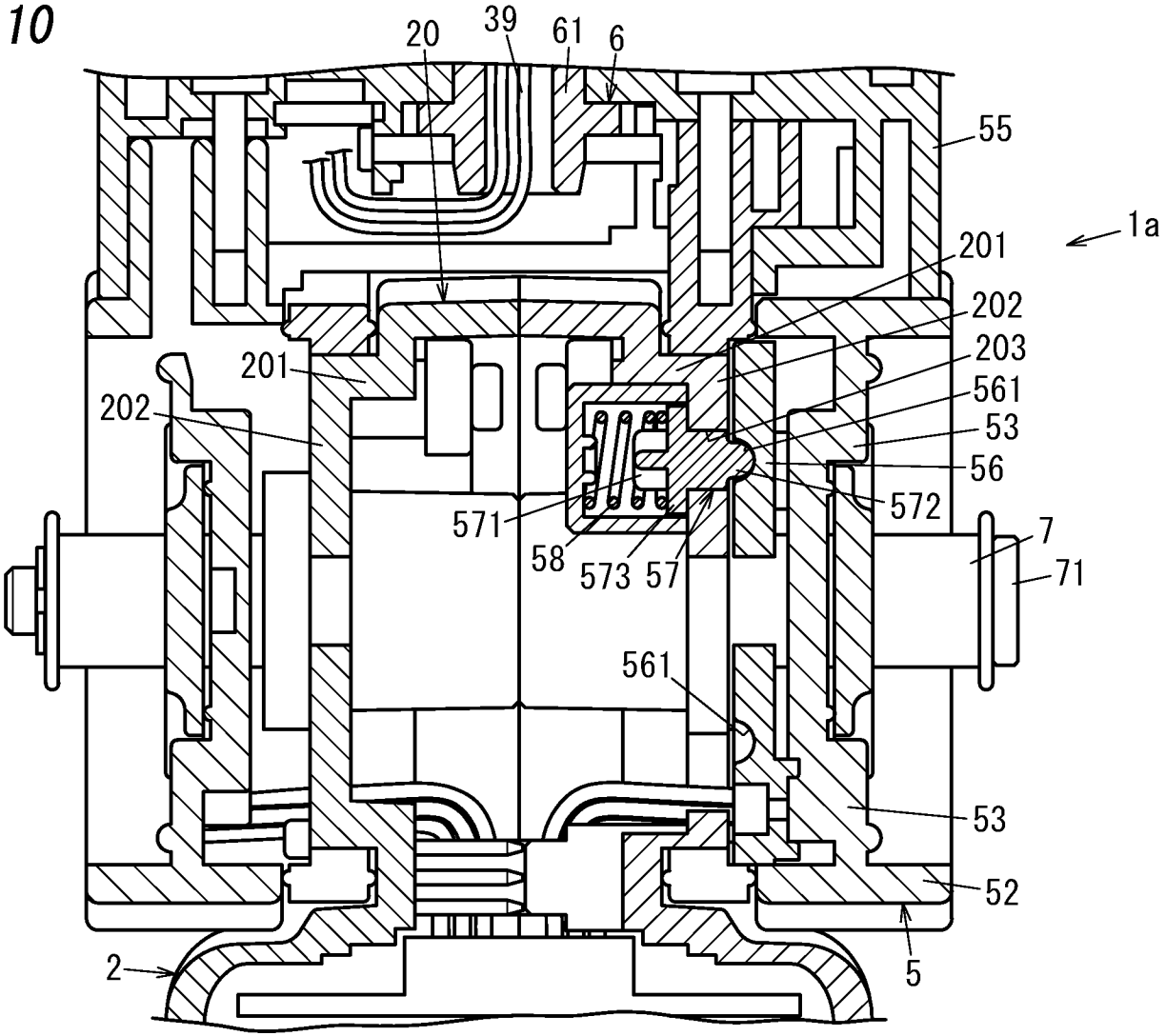
FIG. 10 is a sectional view illustrating the lighting apparatus taken along line X2-X2 of FIG. 2A.

Moreover, as illustrated in FIGS. 4 and 10, each hinge device 5 preferably further includes a click plate 56, a click member 57, and a return spring 58.

The click plate 56 has an arc shape, is laid on the coupler 53, and is fixed to the coupler 53. The click plate 56 has a counter surface which faces the shaft section 201 of the holder 20 and in which a plurality of recesses 561 each having a hemispherical shape are formed. The plurality of recesses 561 have the same size. The plurality of recesses 561 are arranged in the circumferential direction of the click plate 56 at substantially the same intervals. The plurality of recesses 561 are arranged such that the arm 55 is rotatable around the first axis 50 within a first specified range of angles (e.g., 90 degrees).

As illustrated in FIG. 10, the click member 57 includes a base 571 having a columnar shape and a click projection 572. The base 571 is arranged in the holder 20. The click projection 572 protrudes from the shaft section 201 through a hole 203. The hole 203 has a round shape and is formed in a tip wall 202 of the shaft section 201. The base 571 integrally includes a flange 573 having an outer diameter larger than the inner diameter of the hole 203. The base 571 is disposed in the holder 20 such that the axial direction thereof is parallel to the first axis 50 (see FIGS. 4 and 9). The click projection 572 has a hemispherical shape. The click projection 572 is removable from and insertable into each of the plurality of recesses 561 (see FIGS. 4 and 10) in the click plate 56. The return spring 58 is a coil spring. The return spring 58 applies, to the flange 573 of the click member 57, force in a direction in which the click projection 572 protrudes from the shaft section 201. Thus, the click projection 572 is movable between a position at which the click projection 572 protrudes from the shaft section 201 and a position at which the click projection 572 does not protrude from the shaft section 201. In the lighting apparatus 1*a*, when a user rotates the light source units 3 around the first axes 50, the positions of the light source units 3 are easily maintained at desired rotational positions. Moreover, in the lighting apparatus 1*a*, it is possible for a user to perceive click feeling when the user rotates the light source units 3.

The lighting apparatus 1*a* includes the plurality of hinge devices 5, and the plurality of hinge devices 5 are configured such that when the plurality of light source units 3 rotate from the reference position to the spread position, rotation directions of the plurality of light source units 3 are different. More specifically, in the lighting apparatus 1*a*, the two hinge devices 5 are arranged such that the click plates 56 (see FIG. 4) do not overlap each other in the direction of the first axes 50 (see FIG. 4). In the following description, for convenience of explanation, one light source unit 3 of the two light source units 3 may be referred to as a light source unit 3A, and the other light source unit 3 of the two light source units 3 may be referred to as a light source unit 3B. In the example shown in FIG. 7, the light source unit 3A is in the reference position of the light source unit 3A, and the light source unit 3B is in the reference position of the light source unit 3B. Moreover, in FIG. 7, the light source unit 3A rotated to the spread position of the light source unit 3A is shown by the long dashed double-short dashed line, and the light source unit 3B rotated to the spread position of the light source unit 3B is shown by the long dashed double-short dashed line. The angle of rotation of each light source unit 3 around the first axis 50 from the reference position to the spread position by the hinge device 5 is substantially 90 degrees.

As illustrated in FIG. 4, each rotation mechanism 6 couples the light source unit 3 to the hinge device 5 such that the light source unit 3 is rotatable around the second axis 60 transverse to the first axis 50.

Figure 11:
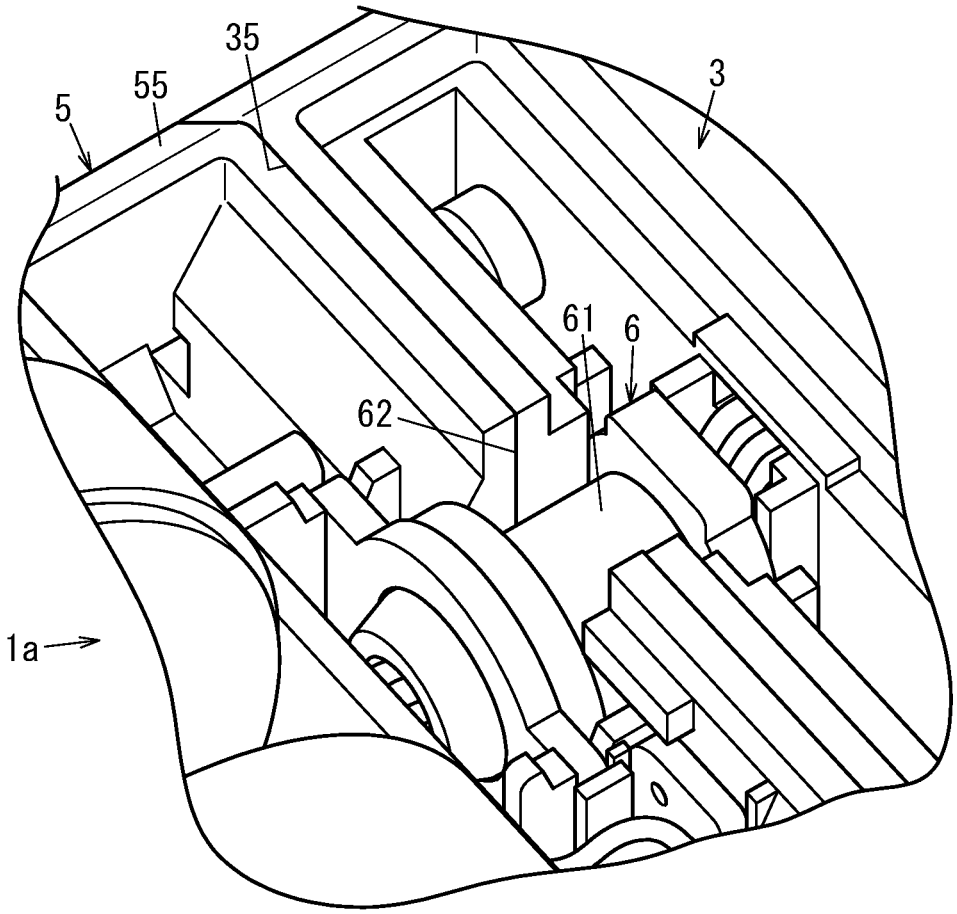
FIG. 11 is a perspective view illustrating a main part of a rotation mechanism of the lighting apparatus.
Figure 12:
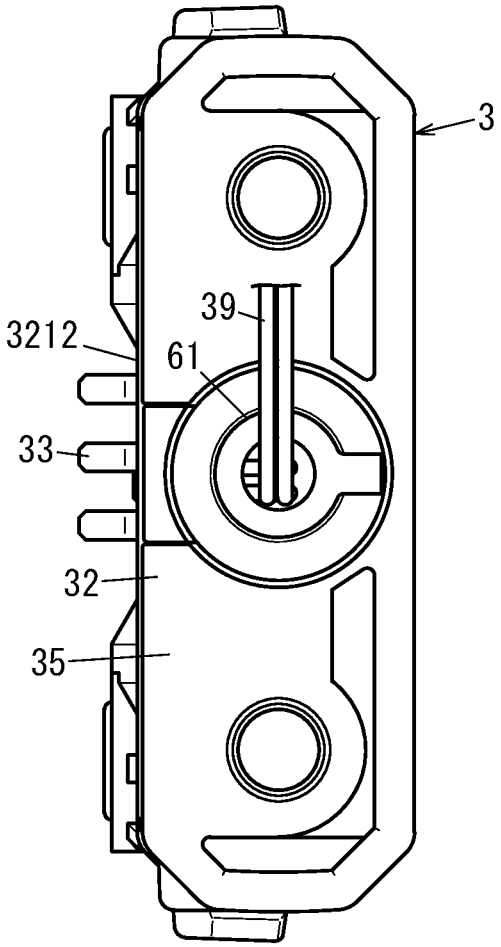
FIG. 12 is a bottom view illustrating the light source unit of the lighting apparatus.

As illustrated in FIGS. 4, 11, and 12, each rotation mechanism 6 includes a shaft section 61 and a bearing 62. The shaft section 61 is coupled to the light source unit 3 at one end in a longitudinal direction of the light source unit 3. The shaft section 61 protrudes from a counter surface 35 of the light source unit 3, the counter surface 35 facing the arm 55 of the hinge device 5. The shaft section 61 has a cylindrical shape. The lead wire 39, which electrically connects the light source unit 3 to power supply unit 8, is inserted through the shaft section 61. The bearing 62 is provided to the arm 55 and freely rotatably holds the shaft section 61. In the lighting apparatus 1*a*, the bearing 62 defines the second axis 60.

In each rotation mechanism 6, the shaft section 61 is coupled to the arm 55 so as to be rotatable around the second axis 60 within a specified range of angles (e.g., 330 degrees) smaller than 360 degrees. The angle of rotation of the light source unit 3 around the second axis 60 by the rotation mechanism 6 is substantially 330 degrees.

The plurality of rotation mechanisms 6 define rotation ranges of the plurality of light source units 3 around the second axes 60 to achieve a reference state where the plurality of light source units 3 are collected together and light-outgoing surfaces 3222 of the plurality of light source units 3 face outward when each of the plurality of light source units 3 is in the reference position. The plurality of light source units 3 are individually rotatable around the first axes 50 and the second axes 60. Note that when each of the plurality of light source units 3 is in the reference position, each of the plurality of light source unit 3 is rotatable around only the first axis 50 and is inhibited from rotating around the second axis 60. In a case where the plurality of light source units 3 includes two light source units 3 and the two light source units 3 are in the reference position, even when one of the two light source units 3 is attempted to be rotated around second axis 60, the presence of the other light source unit 3 inhibits the rotation of the one light source unit 3. When at least one light source unit 3 of the plurality of light source units 3 is at a rotated position around the first axis 50 with respect to the reference position, each of the plurality of light source units 3 is rotatable around the second axis 60.

In the lighting apparatus 1*a*, the coupling device 4 enables the light-outgoing surfaces 3222 of the two light source units 3 to face each other.

The lighting apparatus 1*a* further includes the handle 14 coupled to the coupling device 4. In the lighting apparatus 1*a*, the handle 14 is a component to be gripped by a hand of a user of the lighting apparatus 1*a*. The handle 14 is electrically insulative. The handle 14 is made of a synthetic resin (e.g., polypropylene).

As illustrated in FIGS. 1 and 4, the handle 14 is open toward the base 2 and thus has a U-shape. More specifically, the handle 14 includes a pair of side sections 141, a center section 142 connecting base ends of the pair of side sections 141, and a pair of rotors 143 each provided to a tip of a corresponding one of the pair of side sections 141. Each rotor 143 has a disk shape. In the lighting apparatus 1*a*, the pair of rotors 143 is coupled to the coupling device 4 such that the handle 14 is rotatable around the first axes 50.

As shown in FIGS. 4 and 9, each of the pair of rotors 143 includes a shaft section 1432 rotatably held by the ring section 52 of the hinge device 5, a click member 144, and a return spring 145. The shaft section 1432 has a tip wall 1433 in which a hole 1435 having a round shape is formed. Through the hole 1435, the shaft body 7 is inserted. In the lighting apparatus 1*a*, the coupling device 4 further includes a pair of click plates 49 fixed to the shaft body 7.

Each click plate 49 has a disk shape and is laid on the coupler 53 of the hinge device 5. The click plate 49 has a non-circular hole 490 through which the shaft body 7 is inserted. The click plate 49 has a counter surface which faces the shaft section 1432 of the rotor 143 and in which a plurality of recesses 491 having a semispherical shape are formed. The plurality of recesses 491 have the same size. The plurality of recesses 491 are disposed in the circumferential direction of the click plate 49 at the substantially the same intervals. The plurality of recesses 491 are arranged such that the rotor 143 is rotatable around the first axis 50 within a third specified range of angles (e.g., 360 degrees).

The click member 144 (see FIG. 9) includes a base 1441 having a columnar shape and a click projection 1442. The base 1441 is disposed in the rotor 143. The click projection 1442 protrudes from the shaft section 1432 through a hole 1434 in the tip wall 1433 of the shaft section 1432. The base 1441 integrally has a flange 1443 having an outer diameter larger than the inner diameter of the hole 1434. The base 1441 is disposed in the rotor 143 such that an axial direction thereof is parallel to the first axis 50. The click projection 1442 has a semispherical shape. The click projection 1442 is removable from and insertable into each of the plurality of recesses 491 in the click plate 49. The return spring 145 is a coil spring. The return spring 145 applies, to the flange 1443 of the click member 144, force in a direction in which the click projection 1442 protrudes from the shaft section 1432. Thus, the click projection 1442 is movable between a position at which the click projection 1442 protrudes from the shaft section 1432 and a position at which the click projection 1442 does not protrude from the shaft section 1432. In the lighting apparatus 1*a*, when a user rotates the handle 14 around the first axes 50, the position of the handle 14 is easily maintained at a desired rotational position. Moreover, in the lighting apparatus 1*a*, it is possible for a user to perceive click feeling when the user rotates the handle 14.

As illustrated in FIG. 1, the lighting apparatus 1*a* further includes the grip 15 which is L-shaped and which is formed integrally with the handle 14. In the lighting apparatus 1*a*, the grip 15 is a component to be held by a hand of a user of the lighting apparatus 1*a*. The grip 15 protrudes on an opposite side of the center section 142 of the handle 14 from the pair of side sections 141.

Figures 2A, 2B, 2C:
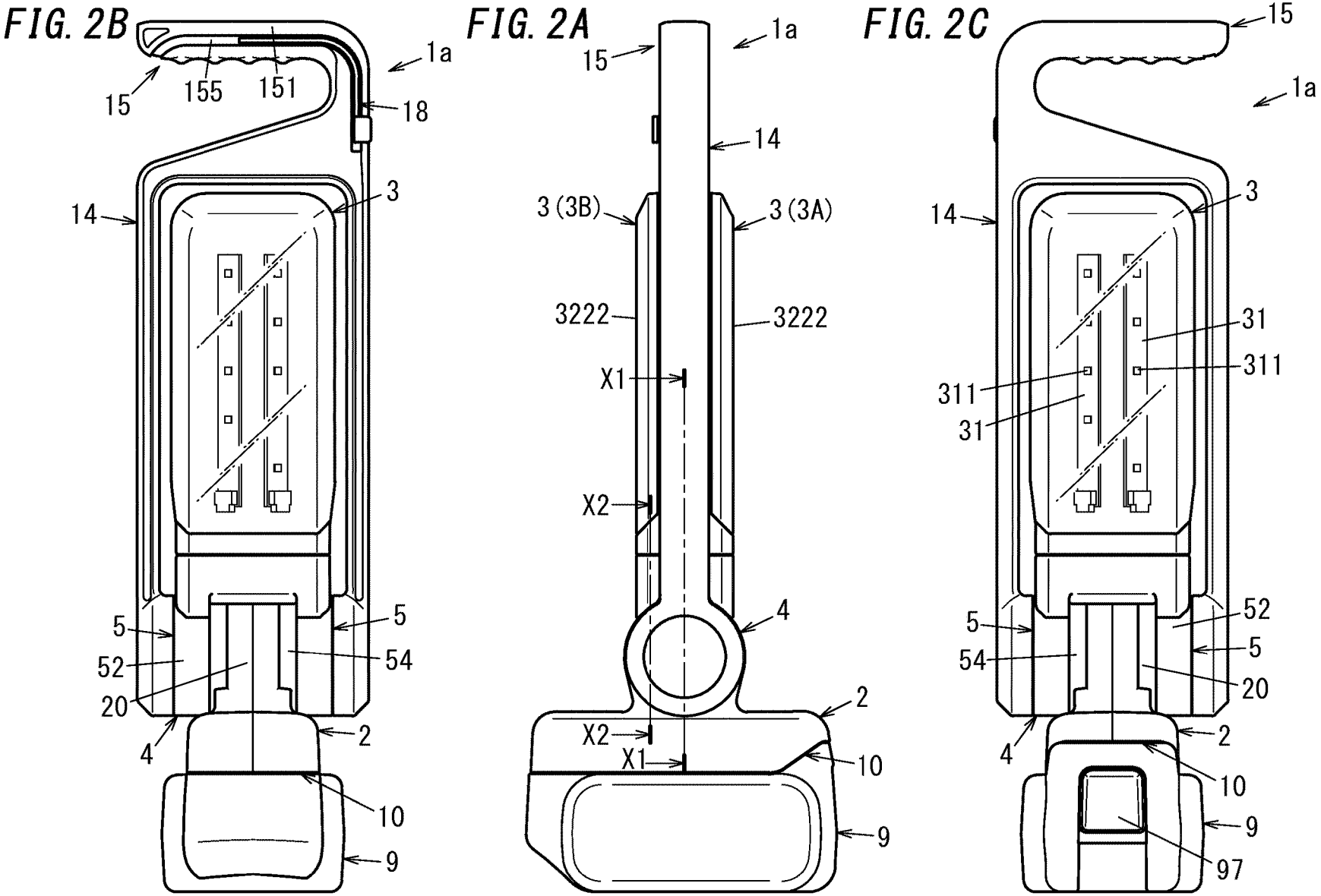
FIG. 2A is a front view illustrating the lighting apparatus.
FIG. 2B is a left side view illustrating the lighting apparatus.
FIG. 2C is a right side view illustrating the lighting apparatus.
Figure 3:
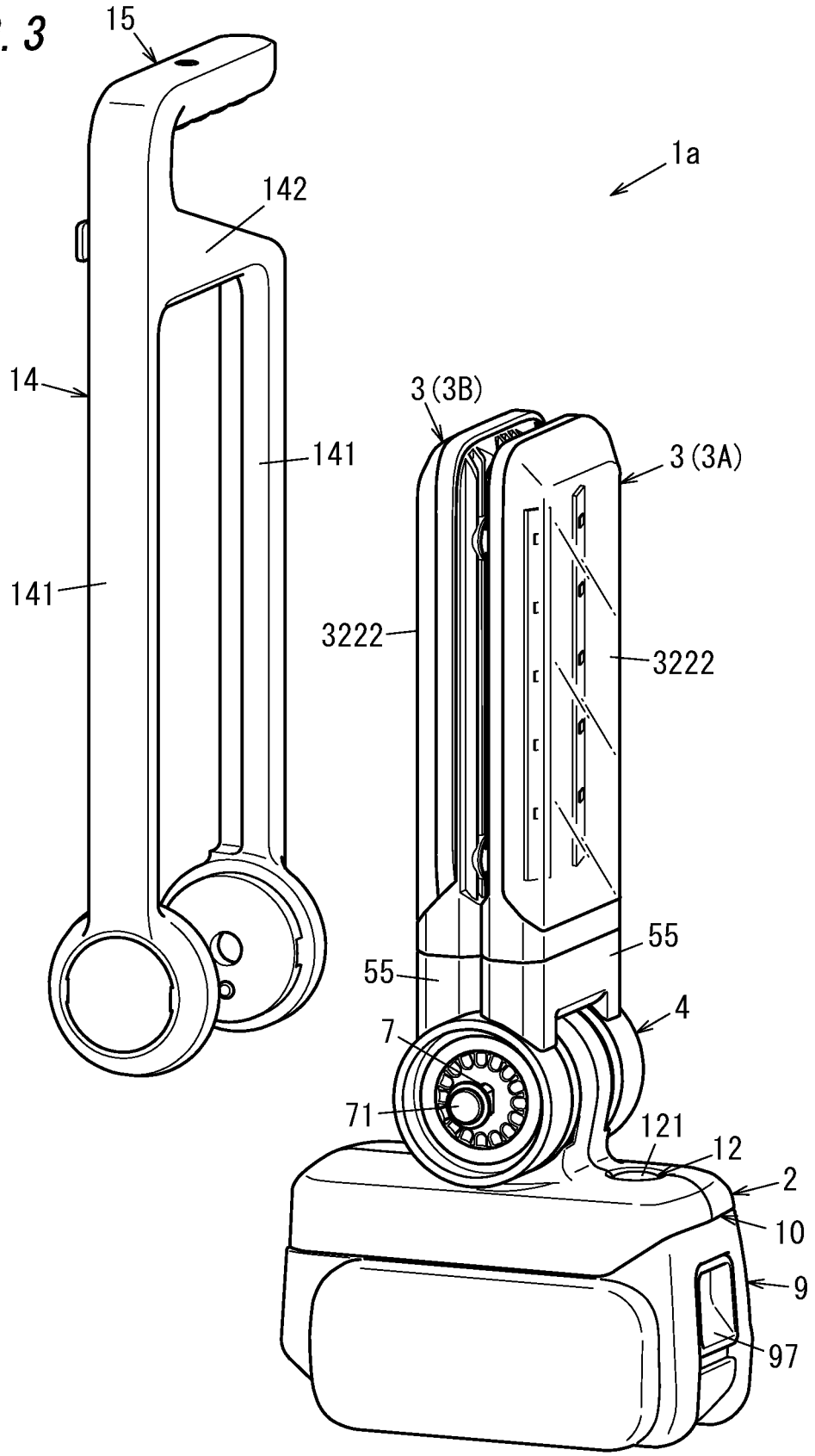
FIG. 3 is a perspective view illustrating the lighting apparatus with a handle being detached.
Figure 13:
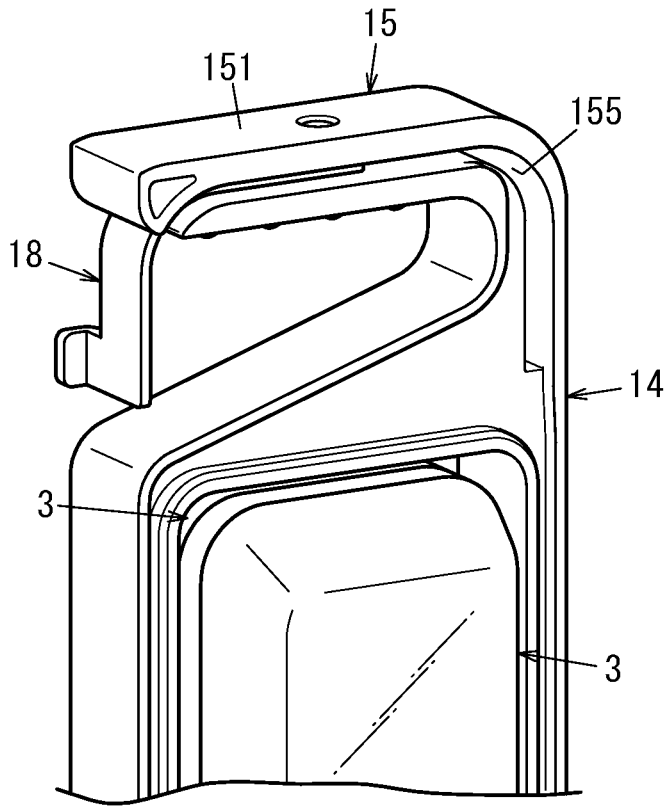
FIG. 13 is a perspective view illustrating a main part of the lighting apparatus with a hook being rotated.

As illustrated in FIGS. 2B and 13, the grip 15 has a side surface 151 having a slit 155 which is L-shaped. In the slit 155 which is L-shaped, a hook 18 which is L-shaped is removably and insertably accommodated. In this embodiment, the hook 18 is rotatably coupled to the grip 15 by a screw 17 (see FIG. 1).

The lighting apparatus 1*a* of the present embodiment described above includes the base 2, the plurality of light source units 3, and the coupling device 4. The coupling device 4 couples the plurality of light source units 3 to the base 2. The coupling device 4 includes the plurality of hinge devices 5 and the plurality of rotation mechanisms 6. The plurality of hinge devices 5 couple the plurality of light source units 3 to the base 2 such that the plurality of light source units 3 are rotatable around the first axes 50. Each of the plurality of light source units 3 is rotatable between the first position (reference position) and the second position (spread position) around a corresponding first axis 50 of the first axes 50. The plurality of rotation mechanisms 6 couple the plurality of light source units 3 to the plurality of hinge devices 5 such that the plurality of light source units 3 are rotatable around the second axes 60 transverse to the first axes 50. The plurality of hinge devices 5 are configured such that when each of the plurality of light source units 3 rotates from the first position to the second position, rotation directions of the plurality of light source units 3 are different. The plurality of rotation mechanisms 6 define rotation ranges of the plurality of light source units 3 around the second axes 60 to achieve a reference state where the plurality of light source units 3 are collected together and light-outgoing surfaces 3222 of the plurality of light source units 3 face outward when each of the plurality of light source units 3 is in the first position.

This configuration enables the lighting apparatus 1*a* to realize various light distributions.

In the lighting apparatus 1*a*, each of the plurality of hinge devices 5 includes the hinge section 54 having a ring shape; the ring section 52, the hinge section 54 and the ring section 52 being rotatable around a corresponding one of the first axes 50; and the arm 55 coupling the hinge section 54 to the ring section 52 and protruding radially outward from the hinge section 54 and the ring section 52. Each of the plurality of rotation mechanisms 6 includes the shaft section 61 and the bearing 62. The shaft section 61 protrudes from the counter surface 35 of a corresponding one of the plurality of light source units 3, the counter surface 35 facing the arm 55. The bearing 62 is provided to the arm 55, freely rotatably holds the shaft section 61, and defines the second axis 60. This allows the lighting apparatus 1*a* to inhibit rotation of the plurality of light source units 3 around the second axes 60 when each of the plurality of light source unit 3 is in the first position. In the lighting apparatus 1*a*, each of the first axes 50 may be orthogonal to a corresponding one of the second axes 60.

In the lighting apparatus 1*a*, the plurality of light source units 3 includes two light source units 3. In the coupling device 4 in the lighting apparatus 1*a*, the first axes 50 each corresponding to an associated one of the two light source units 3 are coincident. Thus, in the lighting apparatus 1*a*, it is possible to relatively increase the size of each of the plurality of hinge devices 5 seen in a direction along the first axes 50. This enables the lighting apparatus 1*a* to make a user imagine various applications for the sake of design emphasizing the plurality of hinge devices 5.

In the lighting apparatus 1*a*, each of the plurality of light source units 3 includes the light source 30 and the case 32 accommodating the light source 30. In this embodiment, the lighting apparatus 1*a* preferably further includes the projection 33 protruding from the rear surface 3212 on an opposite side, of the case 32 from the light-outgoing surface 3222. This enables the lighting apparatus 1*a* to improve heat dissipation characteristics.

In the lighting apparatus 1*a*, the light source 30 includes two LED modules 31. Each of the two LED modules 31 includes the LED 311 and the circuit board 312 on which the LED 311 is mounted. Each of the plurality of light source units 3 is preferably disposed in the case 32 such that the optical axes of the LEDs 311 of the two LED modules 31 are oriented in different directions. Thus, the lighting apparatus 1*a* enables a further increase in the angle of light distribution of each of the plurality of light source units 3. Therefore, the lighting apparatus 1*a* enables a further increase in the angle of light distribution of the lighting apparatus 1*a* as a whole when each of the plurality of light source units 3 is in the first position. In the lighting apparatus 1*a* of the present embodiment, the angle of light distribution can be 360 degrees.

The lighting apparatus 1*a* preferably further includes the attachment part 10 and the power supply unit 8. The attachment part 10 is provided to the base 2, and to the attachment part 10, the battery pack 9 is detachably attached. The power supply unit 8 is accommodated in the base 2 and is configured to light, with the battery pack 9 as a power supply, the plurality of light source units 3. Thus, in the lighting apparatus 1*a*, the power supply unit 8 and the light source unit 3 can be separated, and therefore, it is possible to reduce the size and the weight of the light source unit 3 as compared to a case where the power supply unit 8 is provided integrally with the light source unit 3. Moreover, attaching the battery pack 9 to the attachment part 10 allows the lighting apparatus 1*a* to be used in locations where no external power supply is available.

The lighting apparatus 1*a* preferably further includes the manipulation switch 12 provided to the base 2. In the lighting apparatus 1*a*, the power supply unit 8 may be configured to sequentially switch the plurality of light source units 3 to the full lighting state, the dimming lighting state, and the non-lighting state each time the manipulation switch 12 is manipulated when the battery pack 9 is attached to the attachment part 10 and the power supply unit is supplied with power from the battery pack 9. This enables the lighting apparatus 1*a* to realize various illumination scenes.

Moreover, the lighting apparatus 1*a* preferably further includes the handle 14 which is rotatable around the first axes 50. This enables the lighting apparatus 1*a* to realize various light distributions. Moreover, in the lighting apparatus 1*a*, it is possible to reduce shadows made by the handle 14 blocking light (illumination light) emitted from the light-outgoing surface 3222 of the light source unit 3.

In the lighting apparatus 1*a*, the handle 14 includes the pair of side sections 141, the center section 142 connecting the base ends of the pair of side sections 141, and the pair of rotors 143 each provided at a corresponding one of the tips of the pair of side sections 141. The pair of rotors 143 is preferably coupled to the coupling device 4 such that the handle 14 is rotatable around the first axes 50. This enables the lighting apparatus 1*a* to change the angle of the handle 14 to the light source units 3 and the base 2 around the first axes 50, thereby further improving the degree of freedom of light distribution. Moreover, in the lighting apparatus 1*a*, it is possible to reduce shadows made by the handle 14 blocking light (illumination light) emitted from the light-outgoing surface 3222 of the light source unit 3.

The lighting apparatus 1*a* may further include the grip 15 being L-shaped and protruding on an opposite side of the center section 142 of the handle 14 from the pair of side sections 141. Providing the grip 15 to the lighting apparatus 1*a* enables portability by a user to be improved. Moreover, providing the grip 15 to the lighting apparatus 1*a* increases the degree of freedom of installation place, which makes it possible to realize various light distributions.

The lighting apparatus 1*a* preferably further includes the hook 18 which is L-shaped and which has one end rotatably coupled to a part of the grip 15 by the screw 17. The part of the grip 15 faces the center section 142 of the handle 14. The grip 15 has the side surface 151 having the slit 155 which is L-shaped and in which the hook 18 is removably and insertably accommodated. Providing the hook 18 to the lighting apparatus 1*a* increases the degree of freedom of installation place, which makes it possible to realize various light distributions. Moreover, in the lighting apparatus 1*a*, adopting the hook 18 makes it possible to prevent the lighting apparatus 1*a* from falling. The providing the hook 18 enables the lighting apparatus 1*a* to be used by being hooked on, for example, doors, partitions, and the like of buildings (dwelling units, buildings, facilities, and the like) under construction.

Figure 14B:
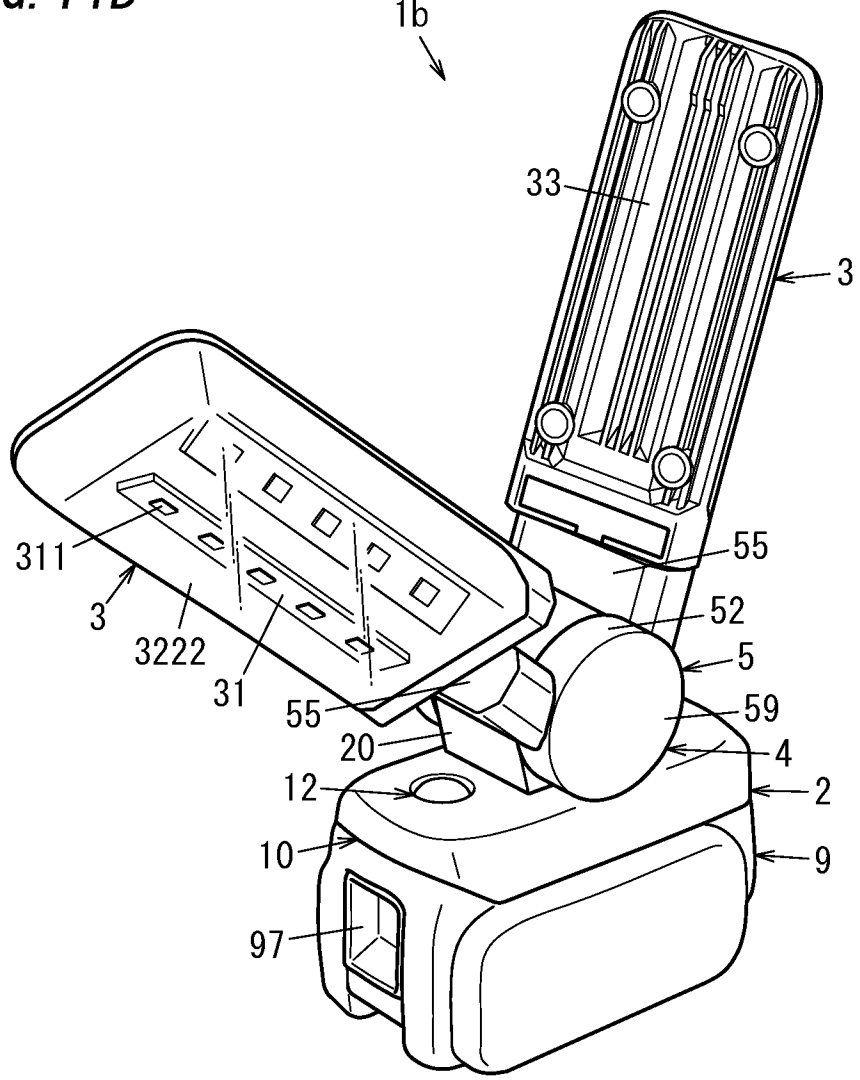
FIG. 14B is a perspective view illustrating an exemplary use of the lighting apparatus according to the first variation.
Figure 14A:
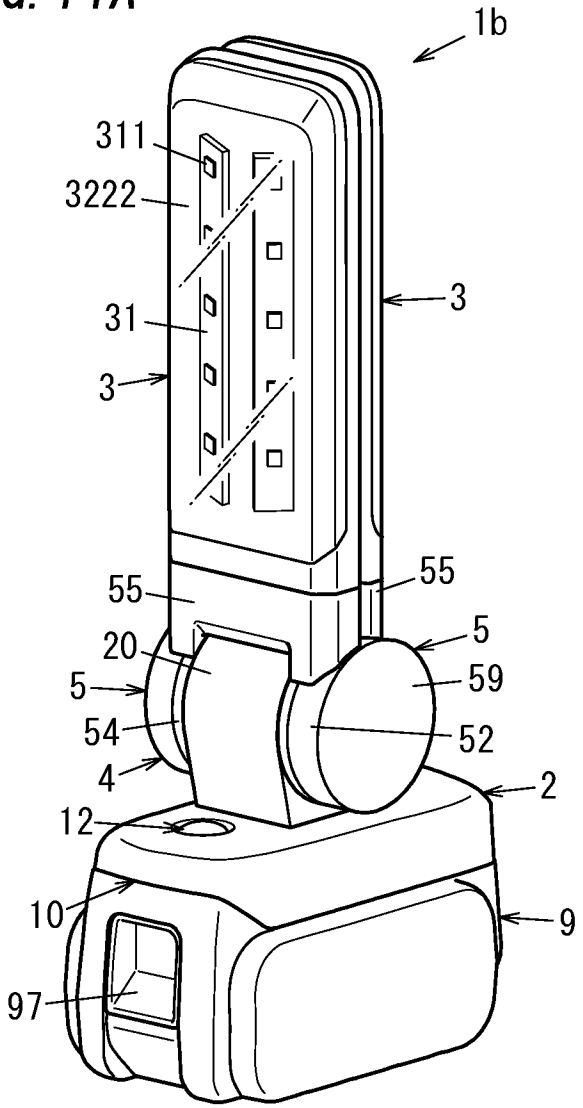
FIG. 14A is a perspective view illustrating a lighting apparatus according to a first variation of the first embodiment of the present invention.

FIG. 14A is a perspective view illustrating a lighting apparatus 1*b* according to a first variation of the first embodiment. FIG. 14B is a perspective view illustrating an exemplary use of the lighting apparatus 1*b*. For the lighting apparatus 1*b*, components similar to those of the lighting apparatus 1*a* in the first embodiment are denoted by the same reference signs as those in the first embodiment, and the description thereof is omitted.

The lighting apparatus 1*b* of the first variation is different from the lighting apparatus 1*a* of the first embodiment in that the handle 14, the grip 15, and the hook 18 of the lighting apparatus 1*a* (see FIG. 1) of the first embodiment are not provided. The lighting apparatus 1*b* of the first variation enables downsizing and cost reduction as compared to the lighting apparatus 1*a* of the first embodiment. The lighting apparatus 1*b* includes a disk-shaped lid 59 closing an opening in a ring section 52 of a hinge device 5 instead of the rotor 143 of the handle 14. This enables the lighting apparatus 1*b* of the first variation to reduce dust or the like externally entering through the opening in the ring section 52.

Figure 15:
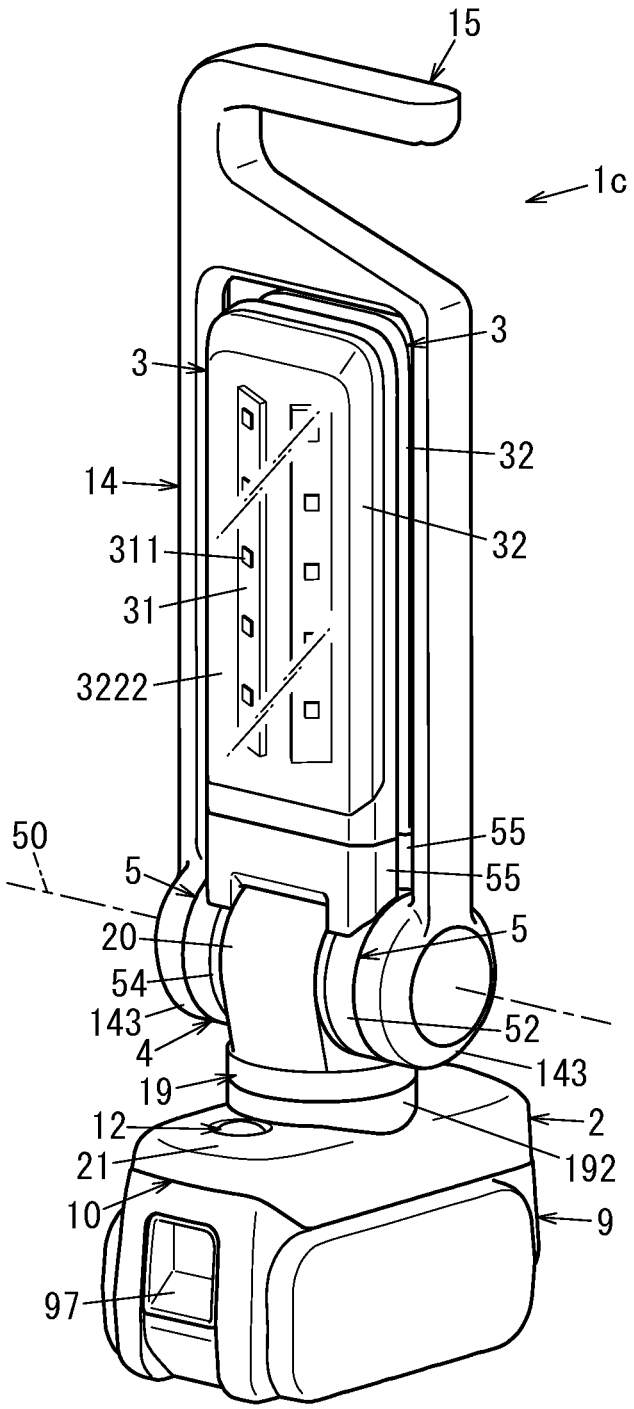
FIG. 15 is a perspective view illustrating a lighting apparatus according to a second variation of the first embodiment of the present invention.

FIG. 15 is a perspective view illustrating a lighting apparatus 1*c* according to a second variation of the first embodiment. For the lighting apparatus 1*c* of the second variation, components similar to those of the lighting apparatus 1*a* in the first embodiment are denoted by the same reference signs as those in the first embodiment, and the description thereof is omitted.

The lighting apparatus 1*c* of the second variation is different from the lighting apparatus 1*a* of the first embodiment in that a coupling device 4 further includes a rotation mechanism 19 rotatable around a third axis transverse to first axes 50 with respect to a base 2. This enables the lighting apparatus 1*c* of the second variation to realize various light distributions as compared to the lighting apparatus 1*a* of the first embodiment.

The coupling device 4 in the lighting apparatus 1*c* of the second variation includes the rotation mechanism 19 (second rotation mechanism) in addition to the plurality of rotation mechanism 6 (first rotation mechanism) of the lighting apparatus 1*a* (see FIG. 4) of the first embodiment.

The rotation mechanism 19 includes a shaft section (not shown) and a bearing 192. The shaft section (not shown) is provided to, for example, a holder 20, is separate from a shaft section 201 (see FIG. 4), and protrudes from the holder 20 toward the base 2. The bearing 192 is provided to the base 2 and rotatably holds the shaft section. In the lighting apparatus 1*c* of the second variation, the bearing 192 provided to the base 2 defines the third axis. The third axis is orthogonal to the first axes 50 (see FIG. 4) and is orthogonal to a first surface 21 of the base 2. In sum, the third axis is orthogonal to the first axes 50 and is parallel to the upward and downward direction in FIG. 15.

Figure 16B:
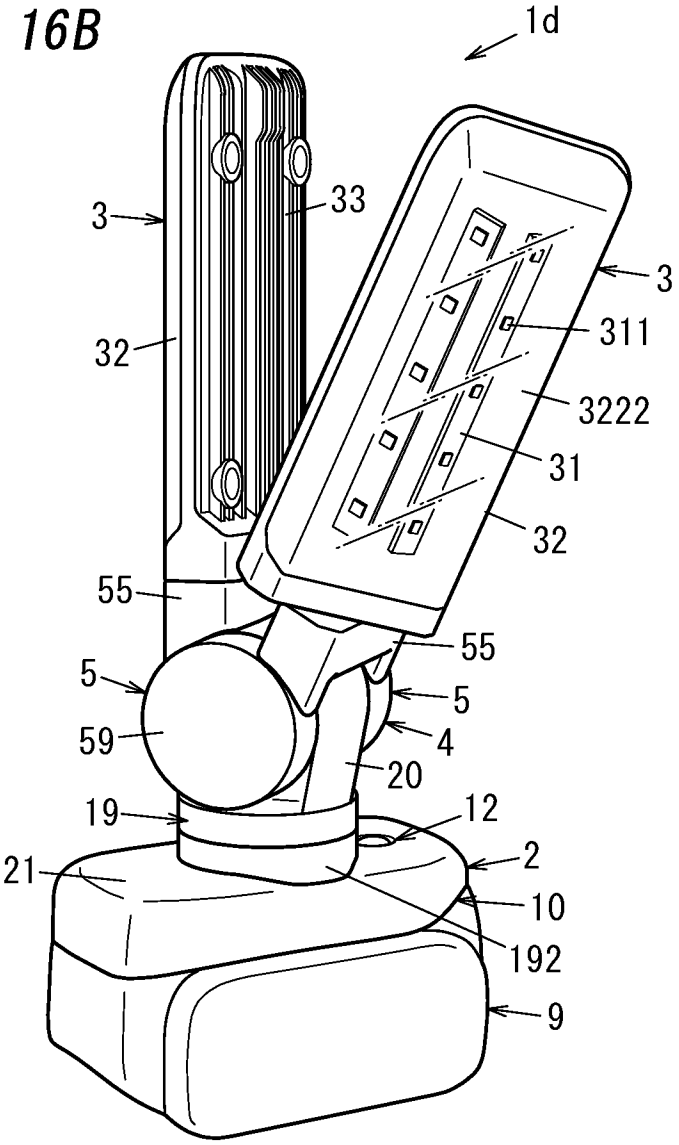
FIG. 16B is a perspective view illustrating an exemplary use of the lighting apparatus according to the third variation.
Figure 16A:
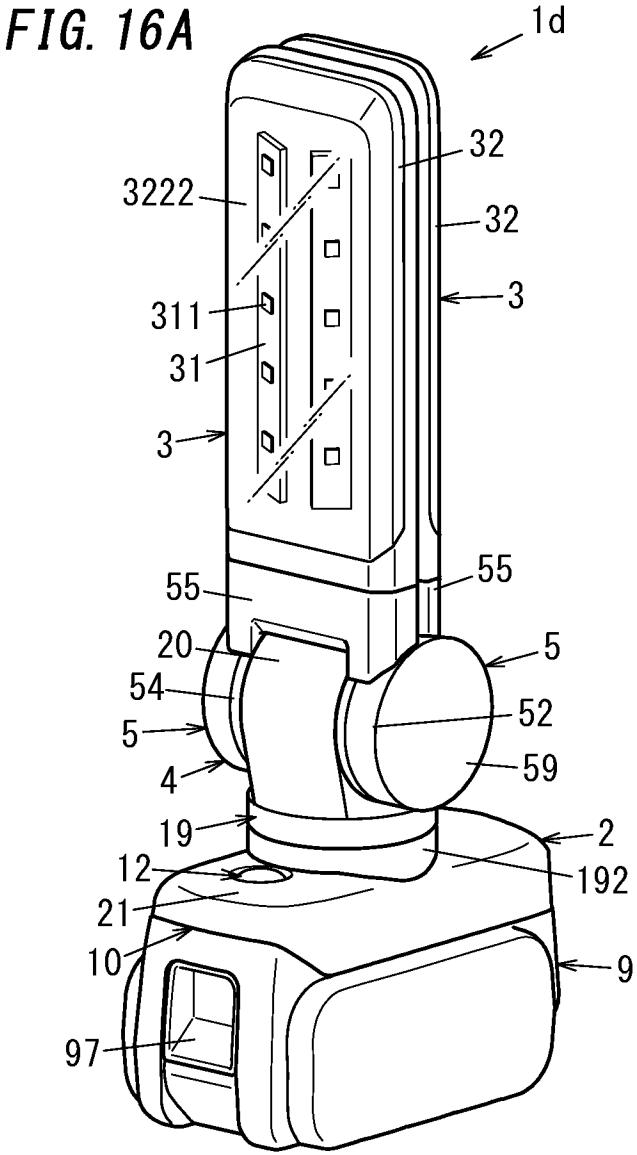
FIG. 16A is a perspective view illustrating a lighting apparatus according to a third variation of the first embodiment of the present invention.

FIG. 16A is a perspective view illustrating a lighting apparatus 1*d* according to a third variation of the first embodiment. FIG. 16B is a perspective view illustrating an exemplary use of the lighting apparatus 1*d* of the third variation. For the lighting apparatus 1*d* of the third variation, components similar to those of the lighting apparatus 1*c* according to the second variation of the first embodiment are denoted by the same reference signs as those in the first embodiment, and the description thereof is omitted.

The lighting apparatus 1*d* of the third variation is different from the lighting apparatus 1*c* of the second variation in that the handle 14, the grip 15, and the hook 18 (see FIG. 13) of the lighting apparatus 1*c* (see FIG. 15) according to the second variation of the first embodiment are not provided. The lighting apparatus 1*d* of the third variation enables downsizing and cost reduction as compared to the lighting apparatus 1*c* of the second variation. The lighting apparatus 1*d* of the third variation includes a disk-shaped lid 59 closing an opening in a ring section 52 of a hinge device 5 instead of the rotor 143 (see FIG. 15) of the handle 14. This enables the lighting apparatus 1*d* of the third variation to reduce dust or the like externally entering through the opening in the ring section 52.

Figure 17:
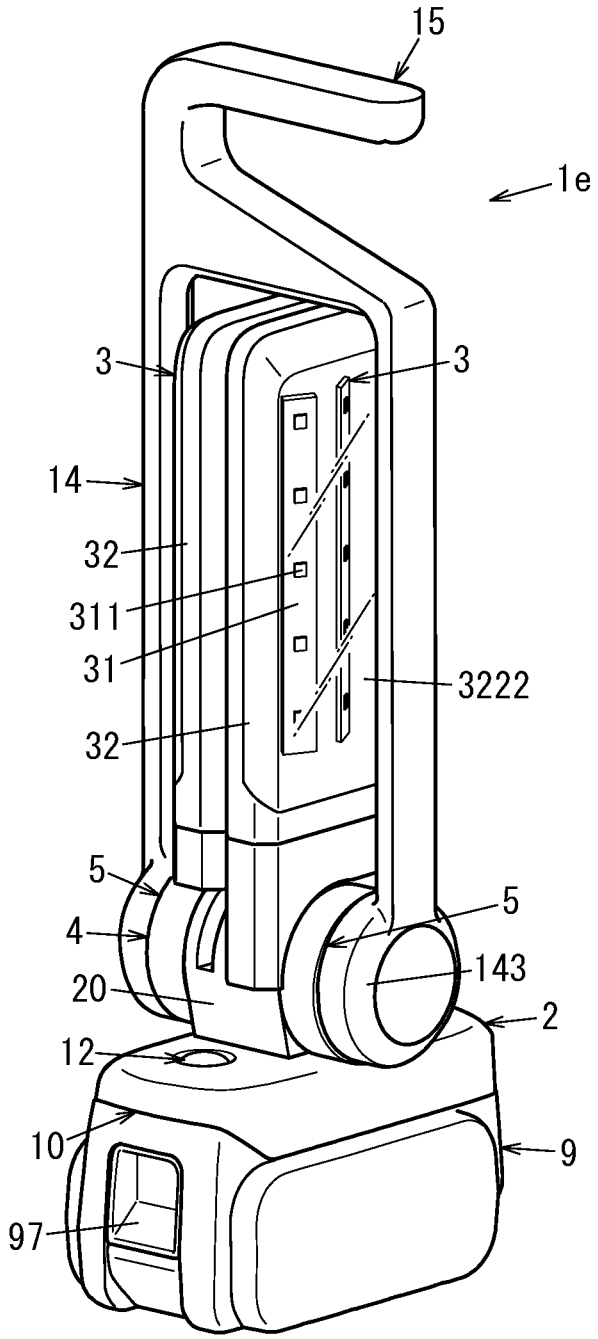
FIG. 17 is a perspective view illustrating a lighting apparatus according to a fourth variation of the first embodiment of the present invention.

FIG. 17 is a perspective view illustrating a lighting apparatus 1*e* according to a fourth variation of the first embodiment. For the lighting apparatus 1*e* of the fourth variation, components similar to those of the lighting apparatus 1*a* in the first embodiment are denoted by the same reference signs as those in the first embodiment, and the description thereof is omitted.

The lighting apparatus 1*e* of the fourth variation is different from the lighting apparatus 1*a* of the first embodiment in that a coupling device 4 is configured such that when each of two light source units 3 are in the first position (reference position), the thickness direction of each light source unit 3 is a direction along first axes 50 (see FIG. 4).

Figure 18B:
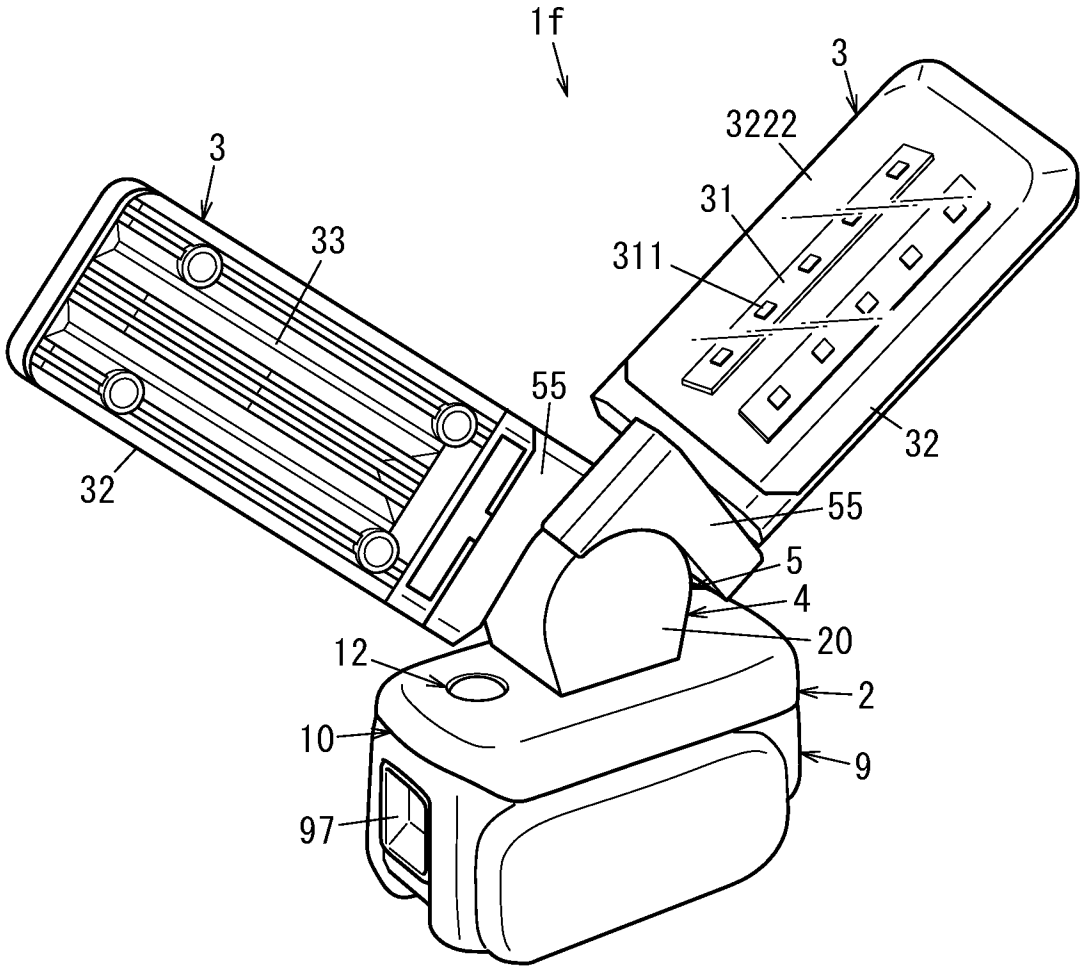
FIG. 18B is a perspective view illustrating an exemplary use of the lighting apparatus according to the fifth variation.
Figure 18A:
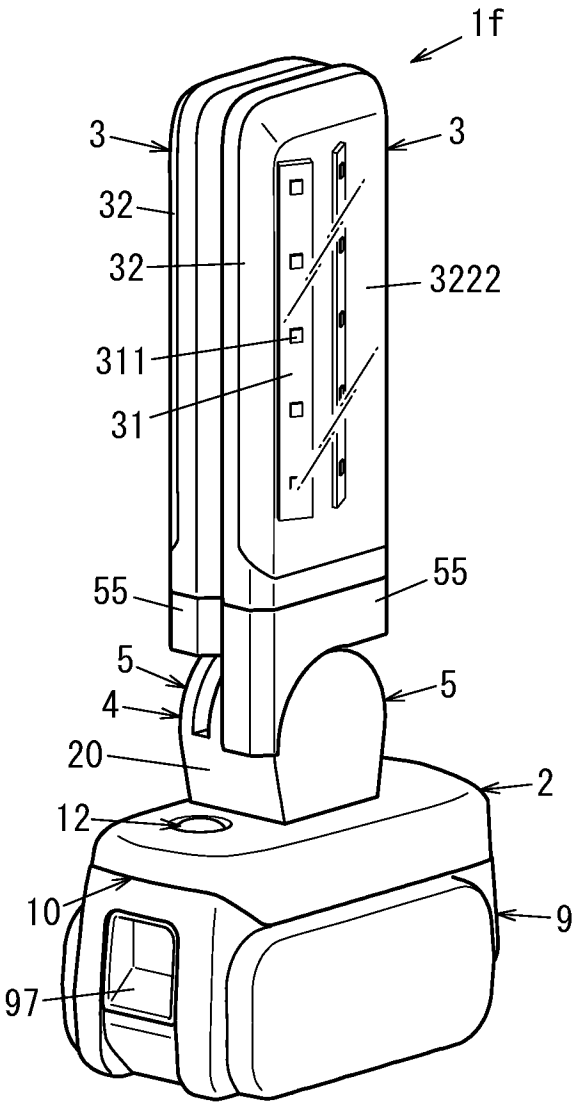
FIG. 18A is a perspective view illustrating a lighting apparatus according to a fifth variation of the first embodiment of the present invention.

FIG. 18A is a perspective view illustrating a lighting apparatus 1*f* according to a fifth variation of the first embodiment. FIG. 18B is a perspective view illustrating an exemplary use of the lighting apparatus 1*f* of the fifth variation. For the lighting apparatus 1*f* of the fifth variation, components similar to those of the lighting apparatus 1*e* according to the fourth variation of the first embodiment are denoted by the same reference signs as those in the first embodiment, and the description thereof is omitted.

The lighting apparatus 1*f* of the fifth variation is different from the lighting apparatus 1*e* of the fourth variation in that the handle 14, the grip 15, and the hook 18 (see FIG. 13) of the lighting apparatus 1*e* (see FIG. 17) of the fourth variation are not provided. The lighting apparatus 1*f* of the fifth variation enables downsizing and cost reduction as compared to the lighting apparatus 1*e* of the fourth variation.

Figure 19B:
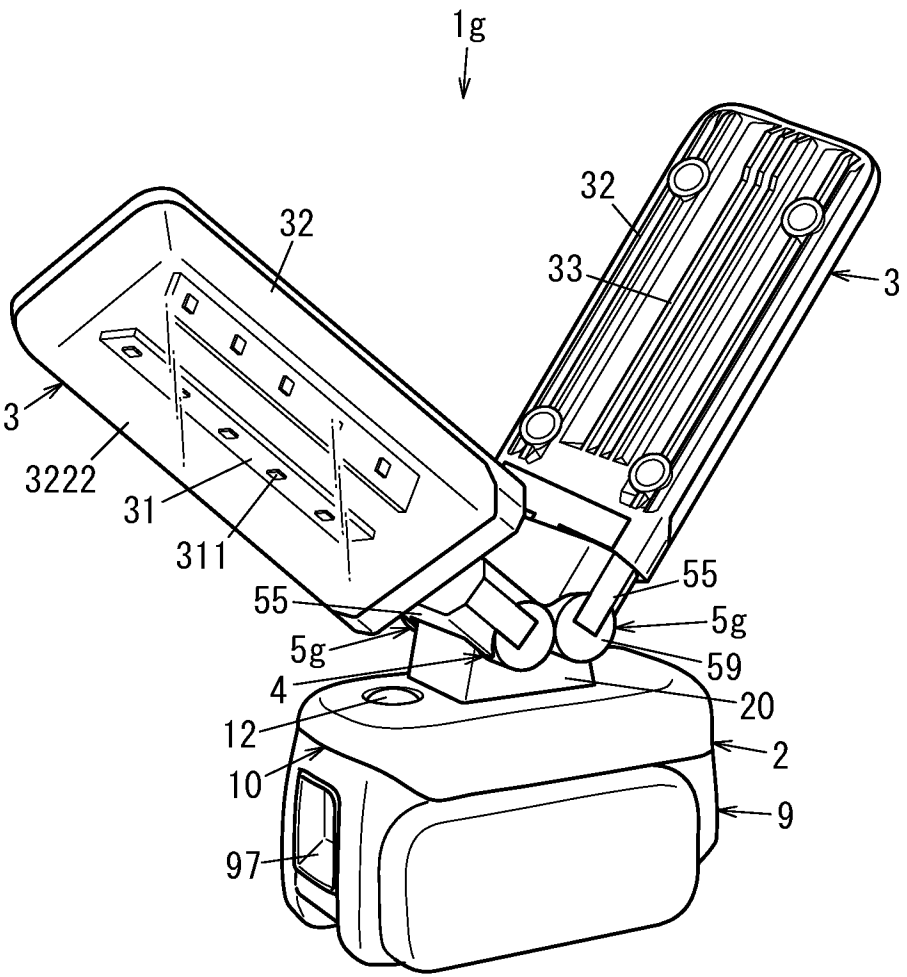
FIG. 19B is a perspective view illustrating an exemplary use of the lighting apparatus according to the sixth variation.
Figure 19A:
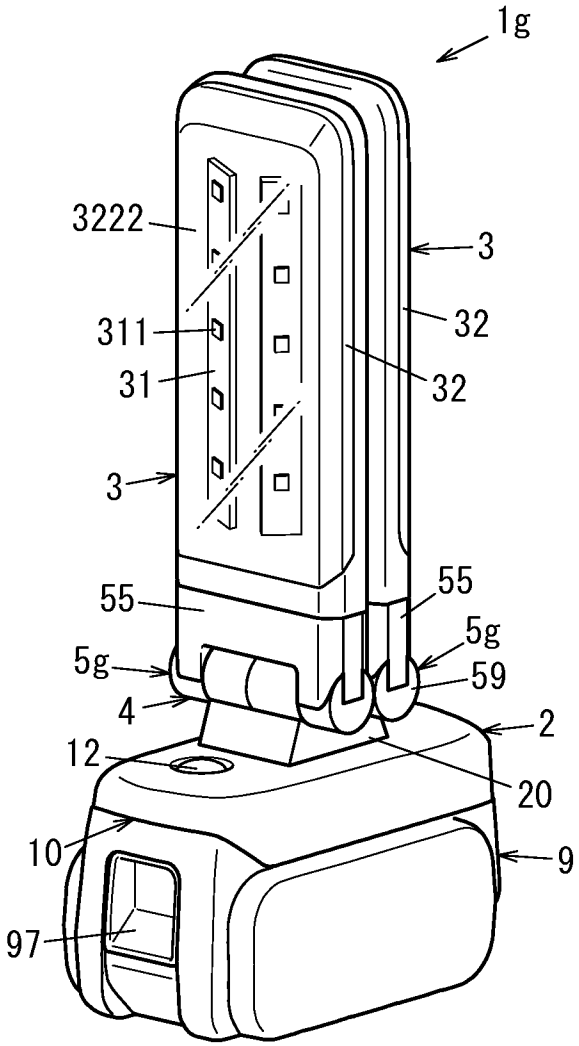
FIG. 19A is a perspective view illustrating a lighting apparatus according to a sixth variation of the first embodiment of the present invention.

FIG. 19A is a perspective view illustrating a lighting apparatus 1*g* according to a sixth variation of the first embodiment. FIG. 19B is a perspective view illustrating an exemplary use of the lighting apparatus 1*g* of the sixth variation. For the lighting apparatus 1*g* of the sixth variation, components similar to those of the lighting apparatus 1*a* in the first embodiment are denoted by the same reference signs as those in the first embodiment, and the description thereof is omitted.

In the lighting apparatus 1*g* of the sixth variation, similarly to the lighting apparatus 1*a* of the first embodiment, the plurality of light source units 3 includes two light source units 3. In the lighting apparatus 1*g*, a coupling device 4 is defined such that first axes 50 (see FIG. 4) each corresponding to an associated one of the two light source units 3 are parallel to each other. Thus, in the lighting apparatus 1*g* of the sixth variation, designing of the coupling device 4 is facilitated. In the lighting apparatus 1*g* of the sixth variation, two hinge devices 5*g* corresponding to the two light source units 3 on a one-to-one basis are laterally arranged. In this embodiment, the lighting apparatus 1*g* of the sixth variation includes two shaft bodies 7 (see FIG. 4) defining the first axes 50 (see FIG. 4). Each hinge device 5*g* couples a corresponding one of the light source units 3 to a base 2 such that the corresponding one of the light source units 3 is rotatable between a first position and a second position around the first axis 50.

Figure 20:
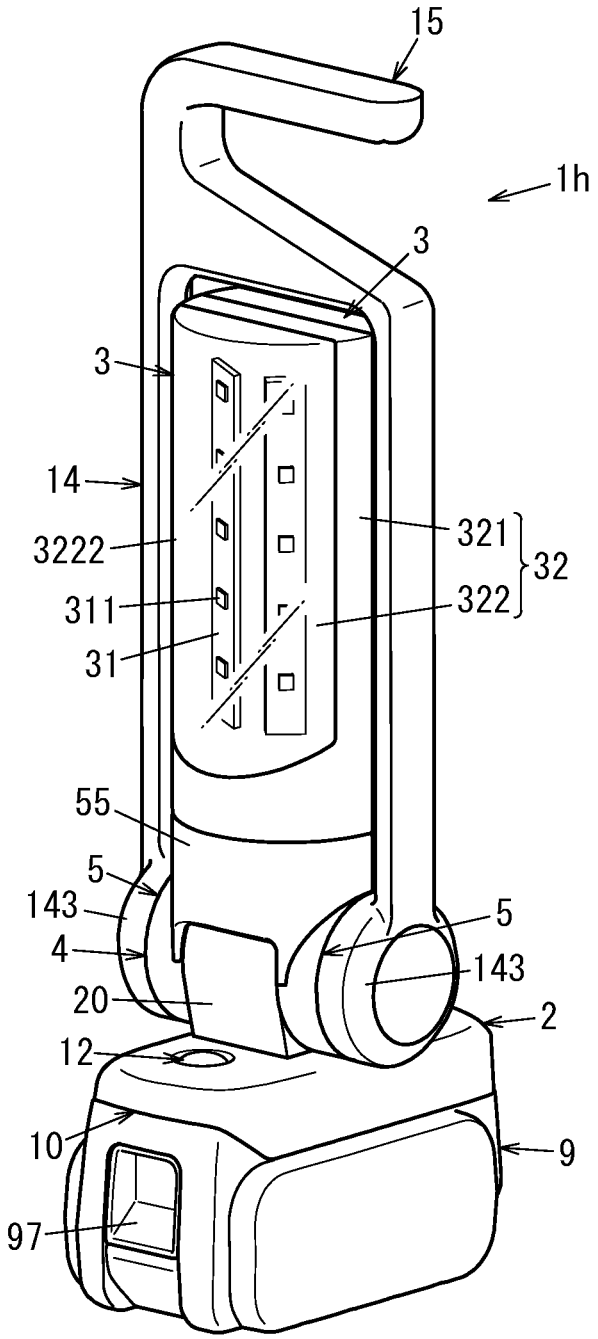
FIG. 20 is a perspective view illustrating a lighting apparatus according to a seventh variation of the first embodiment of the present invention.

FIG. 20 is a perspective view illustrating a lighting apparatus 1*h* according to a seventh variation of the first embodiment. For the lighting apparatus 1*h* of the seventh variation, components similar to those of the lighting apparatus 1*a* in the first embodiment are denoted by the same reference signs as those in the first embodiment, and the description thereof is omitted.

The lighting apparatus 1*h* of the seventh variation is different from the lighting apparatus 1*a* of the first embodiment in that each of two light source units 3 has a semi-cylindrical shape and a light-outgoing surface 3222 is a semi-cylindrical surface.

Figure 21B:
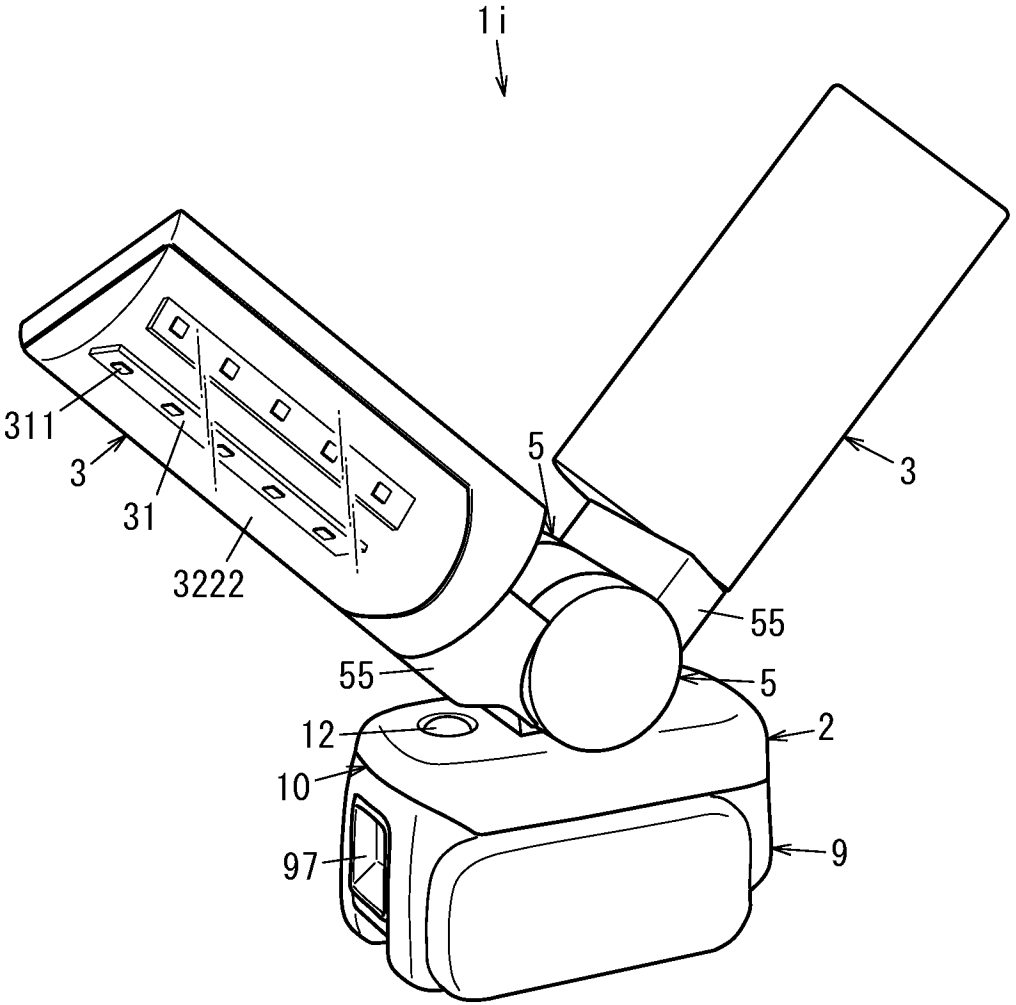
FIG. 21B is a perspective view illustrating an exemplary use of the lighting apparatus according to the eighth variation.
Figure 21A:
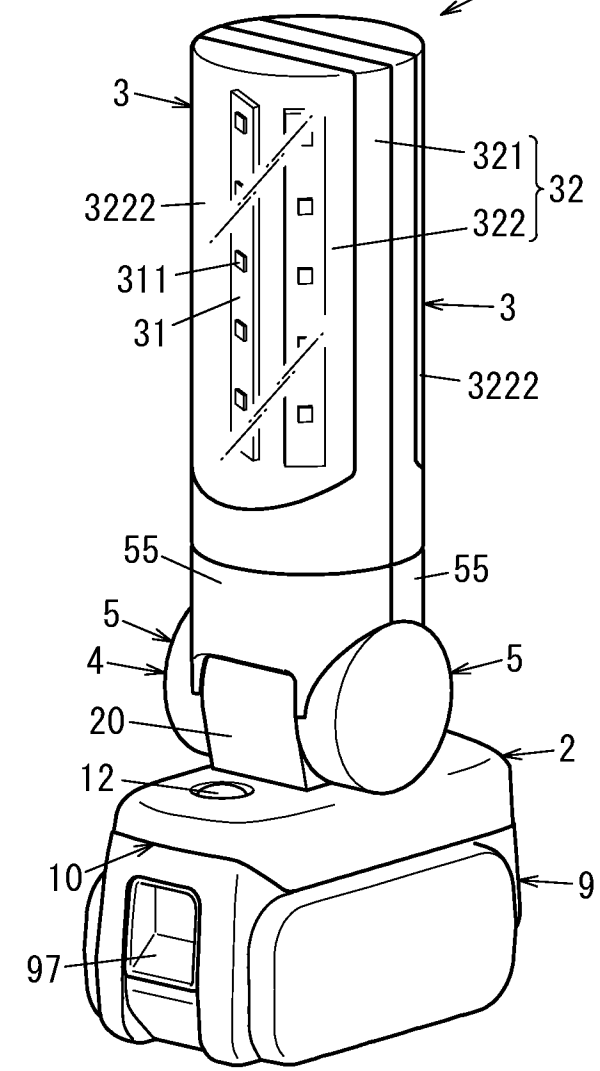
FIG. 21A is a perspective view illustrating a lighting apparatus according to an eighth variation of the first embodiment of the present invention.

FIG. 21A is a perspective view illustrating a lighting apparatus 1*i* according to an eighth variation of the first embodiment. FIG. 21B is a perspective view illustrating an exemplary use of the lighting apparatus 1*i* of eighth variation. For the lighting apparatus 1*i* of the eighth variation, components similar to those of the lighting apparatus 1*h* according to the seventh variation of the first embodiment are denoted by the same reference signs as those in the first embodiment, and the description thereof is omitted.

The lighting apparatus 1*i* of the eighth variation is different from the lighting apparatus 1*h* of the seventh variation in that the handle 14, the grip 15, and the hook 18 (see FIG. 13) of the lighting apparatus 1*h* (see FIG. 20) of the seventh variation are not provided. The lighting apparatus 1*i* of the eighth variation enables downsizing and cost reduction as compared to the lighting apparatus 1*h* of the seventh variation.

Second Embodiment

Figure 22:
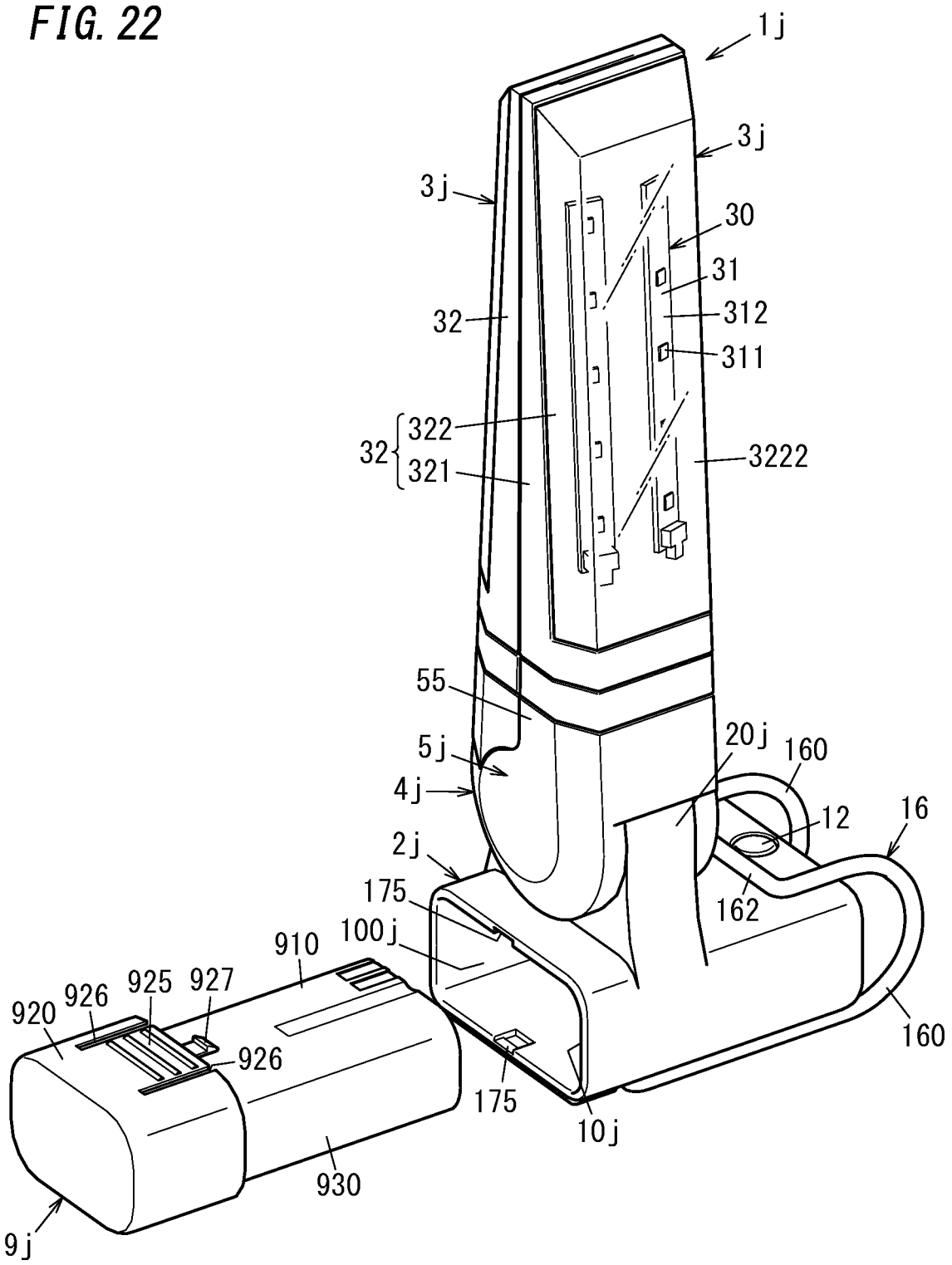
FIG. 22 is a perspective view illustrating a lighting apparatus according to a second embodiment of the present invention with a battery pack being detached.
Figure 23B:
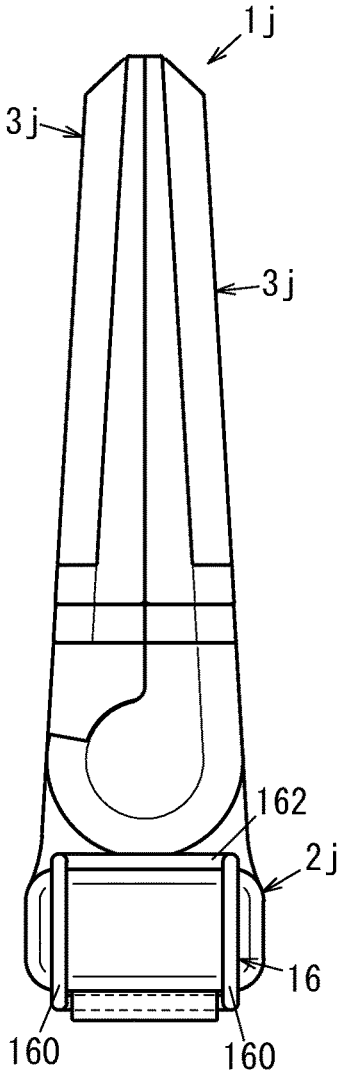
FIG. 23B is a left side view illustrating the lighting apparatus according to the second embodiment.
Figure 23A:
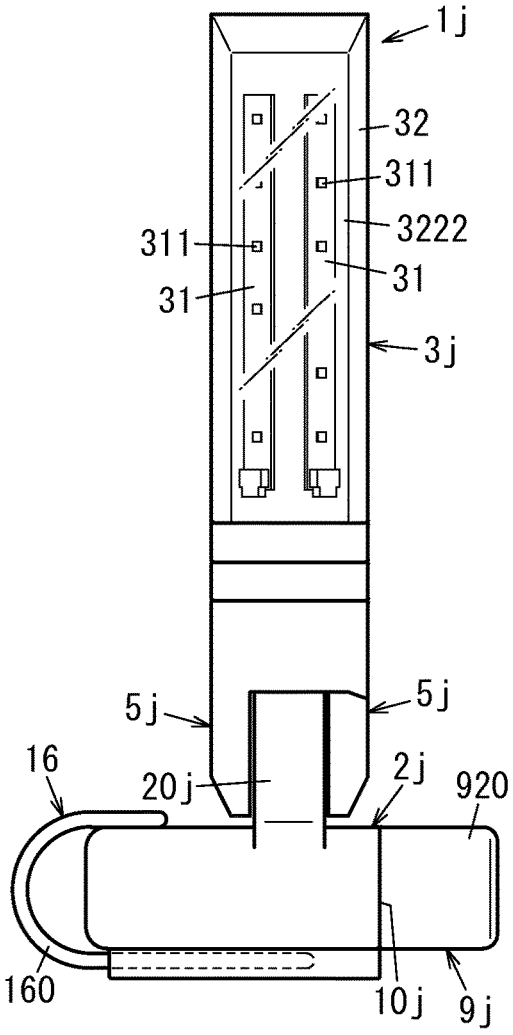
FIG. 23A is a front view illustrating the lighting apparatus according to the second embodiment.
Figure 23C:
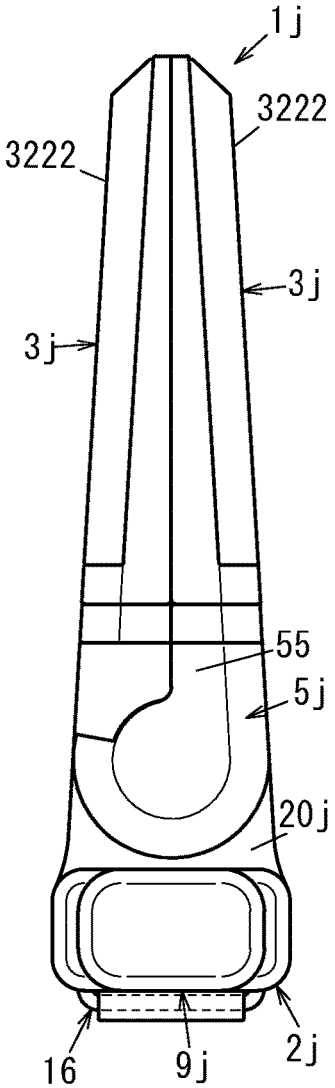
FIG. 23C is a right side view illustrating the lighting apparatus according to the second embodiment.
Figure 23D:
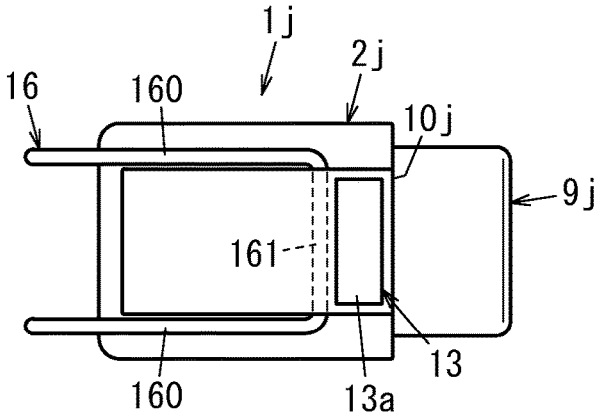
FIG. 23D is a bottom view illustrating the lighting apparatus according to the second embodiment.

A lighting apparatus 1*j* of the present embodiment will be described below with reference to FIGS. 22 and 23.

A basic configuration of the lighting apparatus 1*j* of the present embodiment is substantially the same as that of the lighting apparatus 1*a* in the first embodiment. The lighting apparatus 1*j* of the present embodiment is smaller than the lighting apparatus 1*a* of the first embodiment. For the lighting apparatus 1*j* of the present embodiment, components similar to those of the lighting apparatus 1*a* in the first embodiment are denoted by the same reference signs as those in the first embodiment, and the description thereof is omitted.

The lighting apparatus 1*j* of the present embodiment includes a base 2*j*, a plurality of (two) light source units 3*j*, a coupling device 4*j*, a power supply unit (not shown), a battery pack 9*j*, and an attachment part 10*j* instead of the base 2, the plurality of (two) light source units 3, the coupling device 4, the power supply unit 8, the battery pack 9, and the attachment part 10 of the lighting apparatus 1*a* in the first embodiment.

Moreover, the lighting apparatus 1*j* of the present embodiment is smaller than the lighting apparatus 1*a* of the first embodiment as described above and is not provided with the handle 14, the grip 15, and the hook 18 in the lighting apparatus 1*a* of the first embodiment.

On the other hand, the lighting apparatus 1*j* of the present embodiment further includes a magnet 13 provided to the base 2*j*, and at least one surface 13*a* of the magnet 13 is exposed. Thus, the lighting apparatus 1*j* of the present embodiment is fixable to, for example, a structure formed from a magnetic material (e.g., a desk made of steel). Moreover, the lighting apparatus 1*j* of the present embodiment includes, similarly to the hinge device 5 of the lighting apparatus 1*a* in the first embodiment, hinge devices 5*j* coupling the light source units 3*j* to the base 2*j* such that the light source units 3*j* are rotatable around first axes 50. Each of the light source units 3*j* is rotatable between the first position and the second position around a corresponding first axis 50 of the first axes 50 (see FIG. 4). The coupling device 4*j* includes a holder 20*j* similar to the holder 20 of the coupling device 4 of the lighting apparatus 1*a* in the first embodiment. The coupling device 4*j* further includes a rotation mechanism similar to the rotation mechanism 6 of the coupling device 4 of the lighting apparatus 1*a* in the first embodiment.

The lighting apparatus 1*j* of the present embodiment further includes a hook 16 pivotably held by the base 2*j*. The hook 16 is made of metal. The hook 16 includes a pair of hook bodies 160 having a J-shape, a first coupler 161 which is linear and which couples base ends of the pair of hook bodies 160 to each other, and a second coupler 162 which has an arc shape and which couples tips of the pair of hook bodies 160. The first coupler 161 of the hooks 16 is held by the base 2*j*.

The shape, size, etc. of the battery pack 9*j* is different from those of the battery pack 9 (see FIG. 6). The battery pack 9*j* includes two lithium ion batteries, a housing body 910 in which the two lithium ion batteries are accommodated, and an outer cover 920 which is tubular, which surrounds the housing body 910 at one end in a longitudinal direction of the housing body 910, and which is away from the housing body 910. The battery pack 9*j* includes a pair of manipulation pieces 925 formed on the outer cover 920. Each of the pair of manipulation pieces 925 is part of the outer cover 920. The battery pack 9*j* has slits 926 on both sides of each of the pair of manipulation pieces 925 in a circumferential direction of the outer cover 920. Thus, each of the pair of manipulation pieces 925 can be warped in a thickness direction thereof. Moreover, the battery pack 9*j* has a pair of hooks 927 each protruding from a tip of a corresponding one of the pair of manipulation pieces 925.

The battery pack 9*j* includes the two lithium ion batteries connected to each other in series in the housing body 910. The rated voltage of the battery pack 9*j* is 7.2 V. As the battery pack 9*j*, for example, a lithium ion battery pack EZ9L21 (item number) manufactured by Panasonic Corporation may be adopted.

The battery pack 9*j* provided to the base 2*j* is detachably attached to the attachment part 10*j*. The base 2*j* accommodates a power supply unit (not shown) which lights, with the battery pack 9*j* as a power supply, the plurality of light source units 3*j*.

The attachment part 10*j* has a recess 100*j* which accommodates an insertion section 930 of the housing body 910 of the battery pack 9*j*. The insertion section 930 is not surrounded by the outer cover 920.

The attachment part 10*j* has a pair of grooves 175 formed in an inner peripheral surface of the recess 100*j*. Each of the pair of hooks 927 is engaged with a corresponding one of the pair of grooves 175.

In the lighting apparatus 1*j* of the present embodiment, the insertion section 930 of the battery pack 9*j* is simply inserted into the attachment part 10*j* to attach the battery pack 9*j* to the attachment part 10*j*. Thus, in the lighting apparatus 1*j* of the present embodiment, a pair of power supply terminals (not shown) of the battery pack 9*j* is electrically connected to a pair of connection terminals (not shown) of the attachment part 10*j* on a one-to-one basis, and the pair of hooks 927 is engaged with the pair of grooves 175 in the attachment part 10*j* on a one-to-one basis.

To detach the battery pack 9*j* from the attachment part 10, the pair of manipulation pieces 925 are pushed in a direction in which the pair of manipulation pieces 925 approach each other to release a state where each of the pair of hooks 927 is engaged with a corresponding one of the pair of grooves 175, and the battery pack 9*j* is then pulled out of the attachment part 10*j*.

In the lighting apparatus 1*j* of the present embodiment, each of the plurality of light source units 3 is rotatable around the first axis 50 and around the second axis 60 (see FIG. 4) similarly to the lighting apparatus 1*a* of the first embodiment. Thus, it is possible to realize various light distributions.

The embodiments are mere examples of a variety of embodiments of the present invention. Various modifications may be made to the embodiments depending on design and the like as long as the object of the present invention is achieved.

For example, the circuit boards are not limited to printed wiring boards but may be molded interconnect devices (MID) or the like.

Each of the lighting apparatus 1*a* to 1*i* includes the battery pack 9 and the attachment part 10 but is not limited to this embodiment, and the battery pack 9 and the attachment part 10 do not have to be provided. Similarly, the lighting apparatus 1*j* includes the battery pack 9*j* and the attachment part 10*j* but is not limited to this embodiment, and the battery pack 9*j* and the attachment part 10*j* do not have to be provided. Moreover, the lighting apparatus 1*a* to 1*i* may be configured to receive electric power supplied from an external power supply such as a commercial power supply to light the light source unit 3. In this case, the lighting apparatus 1*a* to 1*i* preferably includes, for example, a power supply cord for receiving the electric power supplied from the external power supply.

Moreover, the lighting apparatus 1*a* may include a lock mechanism for restricting the rotation of at least one of the hinge device 5 and the handle 14. The lock mechanism includes push buttons provided on both ends thereof in the axial direction of, for example, the first axis 50 and is configured to be switched between a locked state and an unlocked state each time the push button is manipulated. The lighting apparatus 1*b* to 1*j* may have similar lock mechanisms.

Each of the lighting apparatuses 1*a* to 1*i* includes two light source units 3, but the number of the light source units 3 is not limited to two. Three or more light source units 3 may be provided. Similarly, the lighting apparatus 1*j* includes two light source units 3*j*, but the number of the light source units 3*j* is not limited to two. Three or more light source units 3*j* may be provided.

REFERENCE SIGNS LIST

1*a*, 1*b*, 1*c*, 1*d*, 1*e*, 1*f*, 1*g*, 1*h*, 1*i*, 1*j* Lighting Apparatus
2, 2*j* Base
3, 3*j* Light Source Unit
30 Light Source
31 LED Module
311 LED
312 Circuit Board
32 Case
3212 Rear Surface
3222 Light-Outgoing Surface
33 Projection
35 Counter Surface
4 Coupling Device
5, 5*g*, 5*j* Hinge Device
50 First Axis
6 Rotation Mechanism
60 Second Axis
8 Power Supply Unit
9, 9*j* Battery Pack
10, 10*j* Attachment Part
12 Manipulation switch
13 Magnet
14 Handle
141 Side section
142 Center section
15 Grip
155 Slit
17 Screw
18 Hook
19 Rotation Mechanism

The invention claimed is:

1. A lighting apparatus, comprising:
a base;
a plurality of light source units;
a coupling device coupling the plurality of light source units to the base; and
a holder protruding from a surface of the base and formed integrally with the base,
wherein
the coupling device includes:
a plurality of hinge devices coupling the plurality of light source units to the base such that the plurality of light source units are rotatable around first axes, each of the plurality of light source units being rotatable between a first position and a second position around a corresponding first axis of the first axes, and
a plurality of rotation mechanisms coupling the plurality of light source units to the plurality of hinge devices such that the plurality of light source units are rotatable around second axes transverse to the first axes,
the plurality of hinge devices are configured such that when each of the plurality of light source units rotates from the first position to the second position, rotation directions of the plurality of light source units are different,
the plurality of rotation mechanisms define rotation ranges of the plurality of light source units around the second axes to achieve a reference state where the plurality of light source units are collected together and light-outgoing surfaces of the plurality of light source units face outward when each of the plurality of light source units is in the first position,
the plurality of light source units includes two light source units,
in the coupling device, the first axes each corresponding to an associated one of the two light source units are coincident,
the lighting apparatus further comprises an attachment part which is provided to the base and to which a battery pack is detachably attached, and
the base is directly below the plurality of the hinge devices of the coupling device,
wherein the attachment part further includes a recess formed in the base to accommodate a projection base section of the battery pack,
wherein the holder pivotally supports each of the two light source units.

2. The lighting apparatus according to claim 1, wherein
each of the plurality of hinge devices includes
a hinge section having a ring shape;
a ring section, the hinge section and the ring section begin rotatable around a corresponding one of the first axes; and
an arm coupling the hinge section to the ring section and protruding radially outward from the hinge section and the ring section, and
each of the plurality of rotation mechanisms includes
a shaft section protruding from a counter surface of a corresponding one of the plurality of light source units, the counter surface facing the arm and
a bearing provided to the arm, freely rotatably holding the shaft section, and defining a corresponding one of the second axes.

3. The lighting apparatus according to claim 1, wherein
the coupling device further includes a rotation mechanism rotatable around a third axis transverse to the first axes with respect to the base.

4. The lighting apparatus according to claim 1, wherein
each of the plurality of light source units includes
a light source and
a case accommodating the light source, and each of the plurality of light source units further includes a projection protruding from a rear surface on an opposite side, of the case from the light-outgoing surface.

5. The lighting apparatus according to claim 4, wherein the light source includes two LED modules, each of the two LED modules includes an LED and a circuit board on which the LED is mounted, and each of the plurality of light source units is disposed in the case such that optical axes of the LEDs of the two LED modules are oriented in different directions.

6. The lighting apparatus according to claim 1, further comprising:

a power supply unit accommodated in the base and configured to light, with the battery pack as a power supply, the plurality of light source units.

7. The lighting apparatus according to claim 6, further comprising a manipulation switch provided to the base, wherein the power supply unit is configured to sequentially switch the plurality of light source units to a full lighting state, a dimming lighting state, and a non-lighting state each time the manipulation switch is manipulated when the battery pack is attached to the attachment part and the power supply unit is supplied with power from the battery pack.

8. The lighting apparatus according to claim 1, further comprising a handle which is rotatable around the first axes.

9. The lighting apparatus according to claim 8, wherein the handle includes a pair of side sections, a center section connecting base ends of the pair of side sections, and a pair of rotors each provided to a corresponding one of tips of the pair of side sections, and the pair of rotors is coupled to the coupling device such that the handle is rotatable around the first axes.

10. The lighting apparatus according to claim 9, further comprising a grip being L-shaped and protruding on an opposite side of the center section of the handle from the pair of side sections.

11. The lighting apparatus according to claim 10, further comprising a hook being L-shaped and having one end rotatably coupled to a part of the grip by a screw, the part facing the center section of the handle, wherein the grip has a side surface having a slit which is L-shaped and in which the hook is removably and insertably accommodated.

12. The lighting apparatus according to claim 1, further comprising a magnet provided to the base, wherein at least one surface of the magnet is exposed.

13. The lighting apparatus according to claim 1, wherein the holder further includes a hole in a pair of shaft sections of the holder that a shaft body of the coupling device is inserted through the hole.

14. A lighting apparatus, comprising:

a base;

a plurality of light source units;

a coupling device coupling the plurality of light source units to the base; and a holder protruding from a surface of the base and formed integrally with the base, wherein the coupling device includes:

a plurality of hinge devices coupling the plurality of light source units to the base such that the plurality of light source units are rotatable around first axes, each of the plurality of light source units being rotatable between a first position and a second position around a corresponding first axis of the first axes, and a plurality of rotation mechanisms coupling the plurality of light source units to the plurality of hinge devices such that the plurality of light source units are rotatable around second axes transverse to the first axes, the plurality of hinge devices are configured such that when each of the plurality of light source units rotates from the first position to the second position, rotation directions of the plurality of light source units are different, the plurality of rotation mechanisms define rotation ranges of the plurality of light source units around the second axes to achieve a reference state where the plurality of light source units are collected together and light-outgoing surfaces of the plurality of light source units face outward when each of the plurality of light source units is in the first position, the plurality of light source units includes two light source units, in the coupling device, the first axes each corresponding to an associated one of the two light source units are coincident, the lighting apparatus further comprises an attachment part which is provided to the base and to which a battery pack is detachably attached, and the base is directly below the plurality of the hinge devices of the coupling device, wherein the attachment part further includes a recess formed in the base to accommodate a projection base section of the battery pack, wherein the holder further includes a hole in a pair of shaft sections of the holder that a shaft body of the coupling device is inserted through the hole.

* * * * *